US010390156B2

(12) United States Patent
Khwaja et al.

(10) Patent No.: US 10,390,156 B2
(45) Date of Patent: Aug. 20, 2019

(54) TACTILE SOUND DEVICE HAVING ACTIVE FEEDBACK SYSTEM

(71) Applicant: SubPac, Inc., Palo Alto, CA (US)

(72) Inventors: Sarosh Khwaja, Palo Alto, CA (US); James A. Kimpel, San Francisco, CA (US); John Alexiou, Palo Alto, CA (US); Todd Chernecki, Palo Alto, CA (US); Peter R. Williams, Belmont, CA (US)

(73) Assignee: SUBPAC, INC., San Francisco, CA (US)

( * ) Notice: Subject to any disclaimer, the term of this patent is extended or adjusted under 35 U.S.C. 154(b) by 0 days.

(21) Appl. No.: 15/588,081

(22) Filed: May 5, 2017

(65) Prior Publication Data

US 2017/0325039 A1 Nov. 9, 2017

Related U.S. Application Data

(60) Provisional application No. 62/333,611, filed on May 9, 2016.

(51) Int. Cl.

| | |
|---|---|
| ***G08B 6/00*** | (2006.01) |
| ***H04R 3/04*** | (2006.01) |
| ***H04R 5/02*** | (2006.01) |
| ***H04R 29/00*** | (2006.01) |

(52) U.S. Cl.

CPC ..... *H04R 29/00* (2013.01); *G08B 6/00* (2013.01); *H04R 3/04* (2013.01); *H04R 5/023* (2013.01); *H04R 2201/023* (2013.01); *H04R 2400/03* (2013.01); *H04R 2460/13* (2013.01)

(58) Field of Classification Search

CPC ..... H04R 29/00; H04R 3/04; H04R 2460/13; H08B 6/00; G09B 21/007; G10L 21/06; G10L 2021/065; G06F 3/167; G06F 3/016; G06F 3/041

See application file for complete search history.

(56) References Cited

U.S. PATENT DOCUMENTS 5,035,235 A * 7/1991 Chesky ..... A61H 23/0236 601/107
5,068,645 A 11/1991 Drumm
5,553,148 A * 9/1996 Werle ..... H04R 5/023 381/151

(Continued)

FOREIGN PATENT DOCUMENTS

WO WO 2011147015 A1 * 12/2011 ..... G09B 21/007

OTHER PUBLICATIONS

Sonar et al, Soft Pneumatic Actuator Skin with piezoelectric Sensors for vibrotactile feedback, Jan. 2016.*

(Continued)

*Primary Examiner* — Davetta W Goins
*Assistant Examiner* — Kuassi A Ganmavo
(74) *Attorney, Agent, or Firm* — Maschoff Brennan

(57) ABSTRACT

A tactile sound device includes a transducer to convert an electrical signal into motion. One or membranes are coupled to the transducer and are adapted to transfer vibrations from the transducer to a user's body. A first sensor monitors the vibrations of the transducer. One or more circuits generate the electrical signal based on a signal received from the first sensor that monitors the vibrations of the transducer.

18 Claims, 17 Drawing Sheets

(56) References Cited

U.S. PATENT DOCUMENTS 5,579,238 A 11/1996 Krugman
7,230,546 B1 6/2007 Nelson et al.
7,451,077 B1 11/2008 Lindau et al.
8,617,089 B2 * 12/2013 Oser ..... A47C 7/72 601/46
2002/0007723 A1 * 1/2002 Ludwig ..... G10H 1/00 84/645
2003/0030521 A1 2/2003 Sweet et al.
2007/0142944 A1 6/2007 Goldberg et al.
2007/0145857 A1 * 6/2007 Cranfill ..... G06F 3/0414 310/319
2008/0306396 A1 * 12/2008 Ariav ..... A61B 5/113 600/527
2010/0110368 A1 5/2010 Chaum
2010/0123588 A1 * 5/2010 Cruz Hernandez ..... A61B 5/02438 340/573.1
2010/0284554 A1 11/2010 Aston et al.
2011/0132181 A1 6/2011 Kockovic
2012/0032906 A1 * 2/2012 Lemmens ..... G06F 3/011 345/173
2012/0126959 A1 5/2012 Zarrabi et al.
2013/0002411 A1 * 1/2013 Henderson ..... H02N 2/005 340/407.1
2013/0106589 A1 * 5/2013 Posamentier ..... G06F 3/016 340/407.1
2013/0202134 A1 * 8/2013 Afshar ..... H04R 1/22 381/151
2013/0300549 A1 * 11/2013 Hill ..... H04M 1/72563 340/407.1
2014/0163439 A1 6/2014 Uryash et al.
2014/0320402 A1 * 10/2014 Stahlberg ..... G08B 6/00 345/156
2015/0063074 A1 3/2015 Oh et al.
2015/0063606 A1 * 3/2015 Alexiou ..... H01L 41/0986 381/151
2015/0070147 A1 * 3/2015 Cruz-Hernandez ..... G08B 6/00 340/407.1
2016/0012688 A1 * 1/2016 Eagleman ..... G06F 3/016 340/407.1
2016/0034033 A1 * 2/2016 Tao ..... H04R 3/14 345/173
2016/0086457 A1 * 3/2016 Baron ..... G08B 6/00 340/407.1
2016/0217778 A1 * 7/2016 Iermenko ..... G10H 3/26
2017/0076564 A1 * 3/2017 Cruz-Hernandez ..... G08B 6/00
2017/0186335 A1 * 6/2017 Matsunaga ..... G09B 19/0038
2017/0281291 A1 * 10/2017 Garratt ..... A61B 50/20

OTHER PUBLICATIONS

"Motional Feedback," Wikipedia.org, 2 pages, 2013, [Online] [Retrieved on Jul. 27, 2017] Retrieved from the Internet<URL:https://en.wikipedia.org/w/index.php?title=Motional_Feedback&oldid=578042251>.

PCT International Search Report and Written Opinion, PCT Application No. PCT/US2017/031307, dated Jul. 19, 2017, 25 pages.

* cited by examiner

TACTILE SOUND DEVICE HAVING ACTIVE FEEDBACK SYSTEM

CROSS REFERENCE TO RELATED APPLICATIONS

This application claims the benefit of U.S. Provisional Patent Application No. 62/333,611, filed on May 9, 2016, the contents of which are incorporated by reference in their entirety.

BACKGROUND

Technical Field

An embodiment of the present disclosure relates generally to an electroactive transducer, such as an electroactive transducer useful in a tactile sound device.

Description of Related Art

Recording engineers, DJ's and music producers are adept at selecting and mixing music and/or sounds during the course of their work. One device that has been developed to aid such professionals is a multistage tactile sound device that takes low frequency sound, typically in the range of about 5 Hz to about 200 Hz, and changes that sound into vibrations which are transferred to the body of a person in contact with such a device either through wearing the wearable sound device or resting against the seated sound device. The frequencies of the sounds that are turned into vibrations tend to be the bass frequencies of the music or sound that is fed into the sound device's control systems. The transfer of these vibrations helps the person feel the music or sound that they are listening to while they are wearing or sitting against this tactile sound device. It is well understood by those skilled in the audio arts, that low frequencies such as those described herein, are generally felt by the listener at any appreciable volume. In this manner, the tactile device provides a more direct and optimized method for a listener to experience those sounds directly, rather that have them transmitted through the air from one or more speakers in a listening environment, where distortions, attenuations, resonances and other acoustic and/or electrical affects may preclude the listener from an optimal experience.

The sound device may for example take the form of a backpack, a seat cushion or a vest. The backpack wearable version of the sound device includes a region that is worn directly adjacent a user's back. The backpack may include straps that pass over the user's shoulders and around their waist to secure the device in direct contact with regions of their body. The version used in a seat can have a region that is positioned against a backrest of the seat and may include straps and/or other securements to hold the sound device in place. In either version of the sound device, music or sounds are fed into the control box, which comprises one or more control systems for a tactile device set, from any of a number of suitable sources. A source device, providing input signals, such as a smartphone, computer, or sound board, may be communicated to the control systems, for example by hard wiring to the control box, using one or more wireless communications methods, for example Bluetooth, wi-fi, and the like. The aforementioned example sound devices may include at least one electroactive transducer that converts electrical signals from at least one control system, for example a control box into vibratory motion. The vibrations can be transferred to vibrotactile membranes provided on the sound device and thereby through the primary and/or secondary membranes to a user's body. This type of sound device may also be used, for example, to enhance the experience of watching videos or movies, playing video games, and wearing virtual reality (VR) headsets through, for example, the rendition of accurate and optimal low frequency audio conveyed through such tactile delivery systems.

For an electroactive transducer mounted in an enclosure, such as the body of a tactile sound device, the frequency response of the transducer depends in part on the forces acting on the transducer. The term "frequency response" as used herein and in audio technology is the frequency range on the x-axis of a graph while signal intensity (often expressed as loudness and measured in decibels) is on the y-axis. A desirable frequency response in such devices may be a flat response curve (in that each frequency is rendered with equal intensity). For static loading conditions, i.e., such as in a speaker or a subwoofer, the desired frequency response of the transducer can be predictably and reliably set in advance with an equalization scheme to counter variations in frequency response brought on by the enclosure, and in some cases by the effects of the environment (for example a home, concert hall, stadium or other environment).

The tactile sound device however, is under dynamic loading conditions and not static loading conditions. Dynamic loading conditions exist because a person wearing or using the device may be moving around and/or because their actual body composition and/or the composition of the seating arrangement to which such device is attached may cause variations in the desired frequency response and/or other audio characteristics. Such dynamic loading conditions may cause the frequency response and/or other audio characteristics of the transducer in the sound device to vary from the initial conditions. This variation makes it difficult to predict and control the output characteristics, including frequency response of the transducer, often causing a frequency response (e.g., a non-flat response curve) or other audio characteristics that are not desired leading to, other undesirable outputs, such as for example phase shift, harmonic, intermodular and other distortions, transient over or under emphasis and/or the like. These dynamic loading conditions can also cause resonance and other distortions and may cause over-excursion and/or create other failure states of internal components in the device.

SUMMARY

An embodiment of the present disclosure seeks to remedy the above-identified issues by monitoring the frequency response of the transducer via one or more sensors and using an active feedback loop to control the activation of the transducer to provide a desired frequency response curve and mitigate other undesirable audio characteristics and/or ensure the safe operation of such transducer. The sensors present may also be used to collect various data which may be transmitted. This electroactive transducer with the integral active feedback loop and the integral amplifier may be used in a tactile sound device. Alternatively, the electronic transducer disclosed herein may be used in conjunction with or incorporated into any wearable sound device or seated type sound device. For instance, the electronic transducer in accordance with an aspect of the present disclosure may be utilized in any type of seat or in any device used in a seated position. Suitable seats that may incorporate such transducers include but are not limited to an office chair, a sofa, a simulator seat, a theme park seat, a theater seat, an automobile seat and the like. The electroactive transducer may be built (e.g. embedded) into a seat or may be in the form of a device that is placed in contact with an exterior surface of a seat or is partially located within a seat and partially protrudes therefrom.

In one embodiment, an electroactive transducer has at least one integral active feedback control loop and at least one integral amplifier. The electroactive transducer may include one or more of a position sensor, orientation sensor, force sensor, load sensor, temperature sensor, pressure sensor, proximity sensor, optical sensor electrical sensor, and/or magnetic sensor; and input from at least on of such sensors can be used to control at least one signal to an amplifier so as to control the frequency response of one or more electroactive transducers.

In some embodiments, an electroactive transducer arrangement may be incorporated into a wearable sound device. The sound device may be a separate unit that is placed against a user's body or is incorporated into clothing or articles that are worn on the body or are positioned against the body. The electroactive transducer may therefore be incorporated into any type of wearable article including but not limited to a backpack, a vest, a body-suit, a jacket or any other garment or piece of clothing.

In one embodiment, an electroactive transducer includes an active feedback control loop and an amplifier. The active feedback control loop may be integrated with a transducer arrangement. Furthermore, the amplifier may be integral with the transducer in that the amplifier and transducer may be in close proximity, including being integrated into a single unit. The active feedback control loop may include one or more sensors that are operatively connected to the amplifier; for example, wherein outputs from one or more sensors may be used as input(s) for one or more subsequent processes such as for example, they may be used to control at least one signal to an amplifier which provides an output electrical signal suitable to control at least one transducer in order to provide an optimal frequency response and/or other audio characteristics, as determined by such active feedback control loop.

In some embodiments, an active feedback control system accommodates the dynamic nature of the application of transducers in delivering, through tactile means, an experience of an audio signal to a user. Such delivery incorporates the accurate transformation of such input audio signals, such that the output of such a transducer arrangement is an accurate representation of the inputs provided to the system. To achieve this, the context of the user and the transducer arrangement are measured and monitored in real time to ensure the accuracy of such representation. One aspect of this representation is the accuracy of the frequency response, whereby the representation of any frequency and/or set thereof has equal relative intensity to the input signal comprising such frequencies.

In some embodiments, a system is disclosed for providing optimal frequency response in an electroactive transducer comprising a feedback control DSP (i.e., a feedback control Digital Signal Processor); a Digital Analog Converter (DAC); an amplifier; an electroactive transducer; and a sensor operatively engaged with the transducer and with the feedback control DSP; and wherein input from the sensor controls at least one signal to an amplifier and thereby controls the frequency response of the transducer. In some embodiments, the sensors may include an accelerometer.

In some embodiments, a tactile sound device comprises a housing and an electroactive transducer positionable within the housing; said electroactive transducer being adapted to generate vibrations that are transferred to a person's body; wherein the electroactive transducer includes an active feedback control loop and an amplifier; and wherein the active feedback control loop and amplifier are integral with the electroactive transducer. Sensors may be placed adjacent to the transducer, may be incorporated into the transducer, may be embedded into one or more membranes and/or may be mounted on a portion of a wearable garment, enclosure, seat or other surface. In some embodiments, transducers may have their positions adjusted so that they can be placed on specific body parts, such as the base of the spine.

In yet another aspect, a method of providing optimal frequency response in an electroactive transducer is disclosed, said method comprising: a) providing an audio system comprising a feedback control DSP; a DAC; an amplifier; the electroactive transducer; and one or more sensors that are operatively engaged with the electroactive transducer and the feedback control DSP; b) generating a known one or more input signals in a predetermined arrangement, including for example a signal with equal intensity of each frequency component of such signal, by way of an electroactive transducer; c) monitoring both the input signals and output generated by such transducers using the one or more sensors; d) comparing the monitored output of such transducer and the deviation from such input signals to ascertain any variance such that a calculated variation may be achieved for a vibration with an optimal frequency response, which is expressed as each frequency having equal or similar intensity.

An optimal frequency response may also be based on a relationship between frequency and intensity that is based on boosting or attenuating certain parts of the frequency spectrum. For example an active feedback system may be configured to achieve a flat frequency response and/or may be configured so as provide other frequency response curves, for example, various preset equalization curves for various genres (for example for dub, hip hop, pop, classical, movie soundtrack and the like), and/or to match with physic-acoustic sense of equal intensity which may vary from an absolute equal intensity across the frequency range (for example emulating Fletcher-Murchison equalization curves and the like).

The method can further comprise e) transmitting an input signal from the one or more sensors to the feedback control DSP. The DSP can create an optimal frequency response through for example f) sending a signal from the feedback control DSP to the DAC g) sending a signal from the DAC to the amplifier; h) sending a signal from the amplifier to the electroactive transducer; i) repeating steps b) to e) and adjusting the input signal based on the monitored vibration.

In some embodiments, such adjustments may be undertaken at one or more frequencies. That is, each output from the one or more sensors may be sampled and/or communicated at differing frequencies to the one or more control systems. For example, a displacement sensor (one that measures the absolute or relative displacement of a transducer from a position of rest) may only communicate with a control system on an exception or threshold basis, where as a force sensor (for example a strain gauge) may be sampled at for example between 10 Hz and 100 Hz, and communicate such information to a control system at the same or less frequency.

In some embodiments, a control system may configure differing sensors (and/or sets thereof) for differing sample rates and frequencies of communication with such control systems. Some sensors may employ one or more algorithms that act upon the incoming raw sensor data to produce, for example, an average, Max-Min, Poisson distribution or other processed output suitable for communication to one or more control systems.

In some embodiments, such a configuration process may be used to monitor and measure the position of a user in relation to such a transducer arrangement, such that if their position changes the active feedback systems through comparison of the expected output with the realized output may vary the input signal to account for this positional change. In some embodiments, such information can be used to calculate one or more preferences of a user and change certain characteristics of the input signal to vary the output; for example, a measurement correlated with a user pressing firmly against the unit may be used to infer a user preference for higher overall intensity, which may be used to change the overall output intensity.

As the transducers may output predominately low frequencies, for example those below 200 Hz, the time latency inherent within the active feedback processing is sufficiently low, in the order in some embodiments of tens of milliseconds, so as to be considered as real time, given that for example a 100 Hz signal has a 10 ms duration, such that a variation of the input signal by the active feedback system will likely occur before the next occurrence of such an input signal that comprises music or other transient material (for example a film score or sound effects track).

In one embodiment, a tactile sound device comprises a transducer to convert an electrical signal into motion; one or more membranes coupled to the transducer and which are adapted to transfer vibrations from the transducer to a user's body; a first sensor to monitor the vibrations of the transducer; and one or more circuits to generate the electrical signal based on a signal received from the first sensor that monitors the vibrations of the transducer.

In one embodiment, the one or more circuits comprise a digital signal processor (DSP) to receive an audio input signal and the signal from the first sensor, the DSP processing the audio input signal to generate a modified signal based on the signal from the first sensor; a digital to analog converter (DAC) to convert the modified signal into an analog signal; and an amplifier to amplify the analog signal to generate the electrical signal for the transducer.

In one embodiment, the transducer includes an enclosure, and the first sensor and the amplifier are located within the enclosure. In one embodiment, the first sensor is embedded within the one or more membranes.

In one embodiment, the one or more circuits adjust an equalization of the electrical signal based on the signal received from the first sensor.

In one embodiment, the one or more circuits compare a desired frequency response with a frequency response of the vibrations as indicated by the signal received from the first sensor, and adjust the equalization of the electrical signal based on the comparison.

In one embodiment, the first sensor is an accelerometer.

In one embodiment, the tactile sound device includes a second sensor that is a different type of sensor than the first sensor. The one or more circuits generate the electrical signal for the transducer further based on a signal received from the second sensor.

In one embodiment, the second sensor is a temperature sensor, and the one or more circuits generate the electrical signal for the transducer based on a signal received from the temperature sensor.

In one embodiment, the second sensor is a pressure sensor, and the one or more circuits generate the electrical signal for the transducer based on a signal received from the pressure sensor.

In one embodiment, the second sensor is a proximity sensor, and the one or more circuits generate the electrical signal for the transducer based on a signal received from the proximity sensor.

In one embodiment, the second sensor is a hall effect sensor, and the one or more circuits generate the electrical signal for the transducer based on a signal received from the hall sensor.

In one embodiment, the second sensor is an orientation sensor, and the one or more circuits generate the electrical signal for the transducer based on a signal received from the orientation sensor.

In one embodiment, the second sensor is a microphone that monitors sound from a loudspeaker and/or headphones, and the one or more circuits generate the electrical signal for the transducer based on a signal received from the microphone. In one embodiment, the one or more circuits adjust a phase of the electrical signal for the transducer based on the signal received from the microphone and the signal received from the first sensor.

In one embodiment, the one or more circuits adjust an equalization of the electrical signal provided to the transducer based on the signal received from the first sensor. The one or more circuits adjust the electrical signal provided to the transducer based on the signal received from the second sensor to prevent unsafe operating conditions.

In one embodiment, the one or more circuits perform low pass filtering on an input audio signal to identify low frequency components below a low pass cut-off frequency, the one or more circuits generating the electrical signal for the transducer to include the low frequency components.

In one embodiment, the tactile sound device is a wearable device. In one embodiment, the tactile sound device is a seat.

In one embodiment, a method of operation in a tactile sound device comprises: converting an electrical signal into motion with a transducer of the tactile sound device; transferring vibrations from the transducer to a user's body through one or more membranes of the tactile sound device that are coupled to the transducer; monitoring the vibrations of the transducer with a first sensor; and generating the electrical signal based on a signal received from the first sensor that monitors the vibrations of the transducer.

BRIEF DESCRIPTION OF THE DRAWINGS

Embodiments of the disclosure are set forth in the following description, is shown in the drawings and is particularly and distinctly pointed out and set forth in the appended claims.

Similar numbers refer to similar parts throughout the drawings.

DETAILED DESCRIPTION

FIGS. 1-4 and 6-8 show a wearable tactile sound device 10 in accordance with an aspect of the present disclosure. FIGS. 5A-5C show a PRIOR ART transducer and a signal flow through a tactile sound device incorporating the PRIOR ART transducer.

Figure 1:
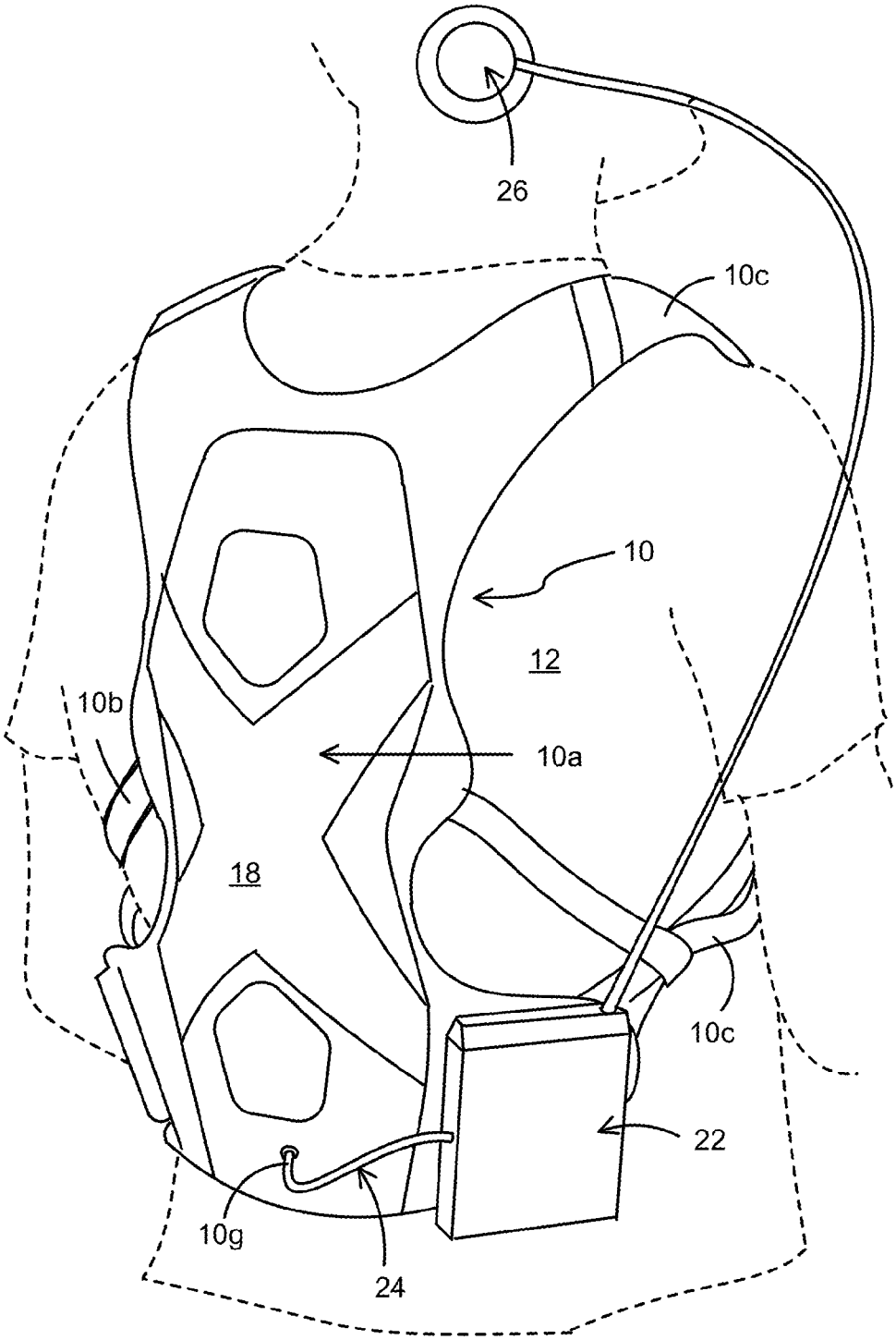
FIG. 1 is a rear perspective view of a tactile sound device shown in the form of a backpack worn on a user's body.
Figure 2:
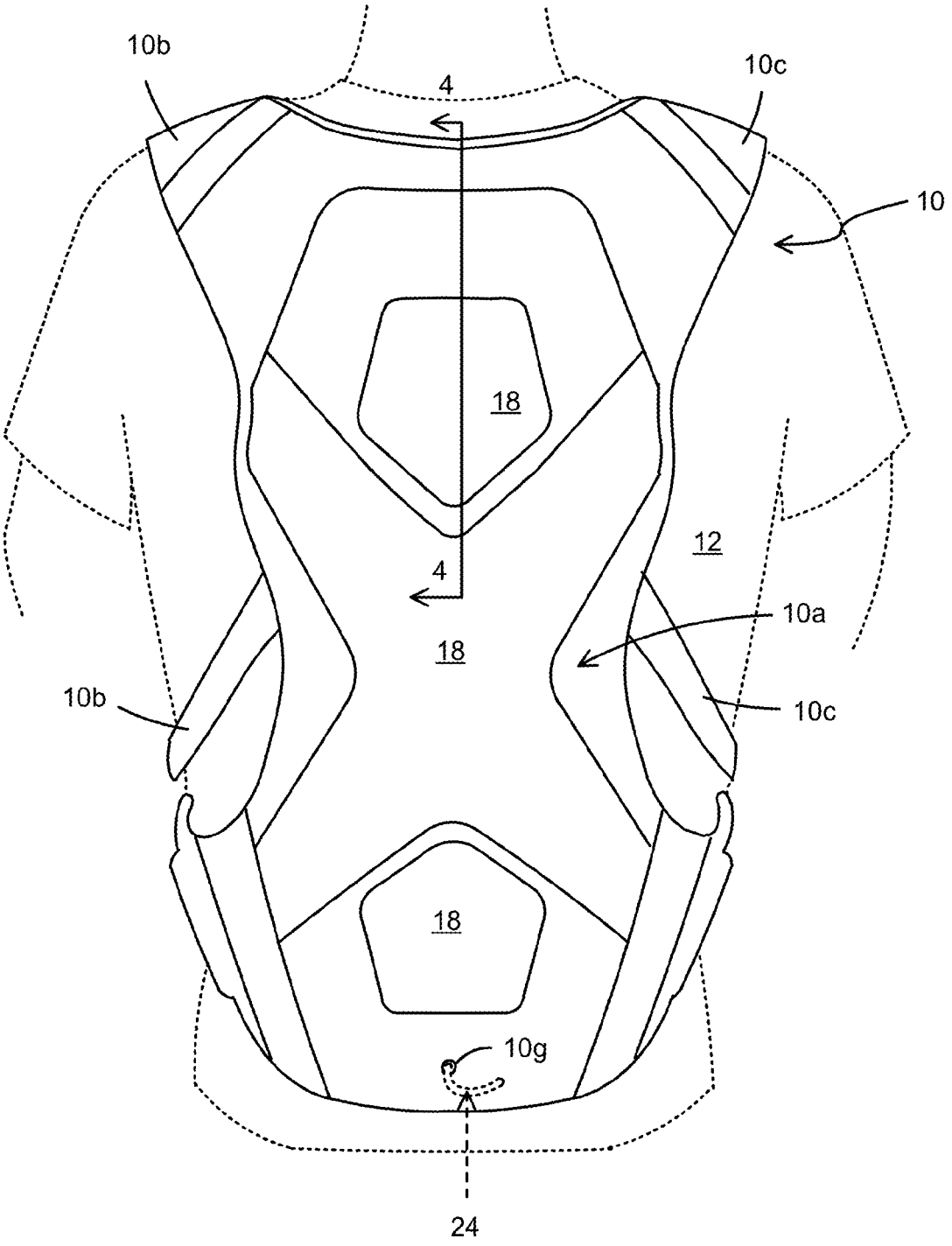
FIG. 2 is a rear view thereof.
Figure 3:
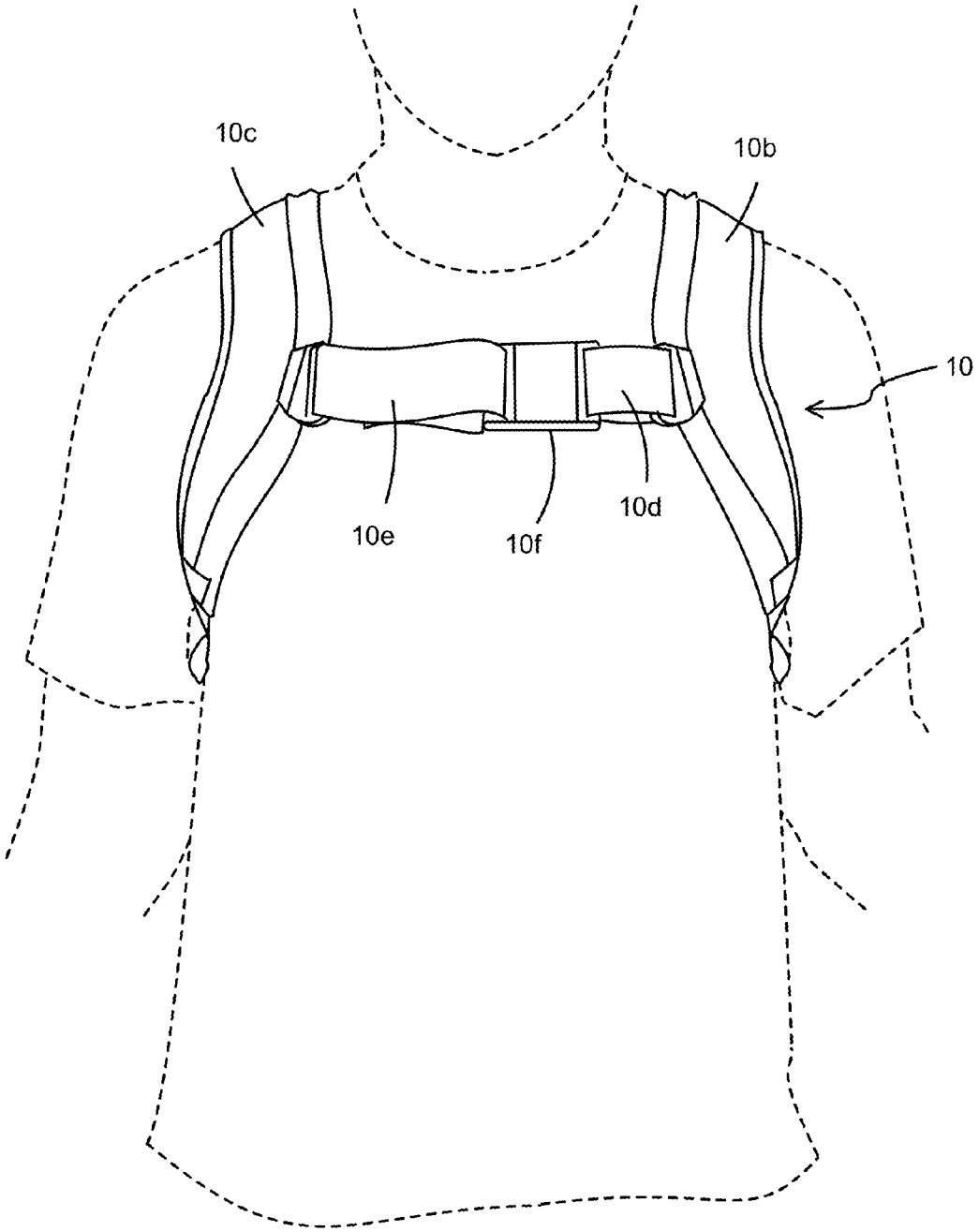
FIG. 3 is a front view thereof.

Referring to FIGS. 1-3, sound device 10 is illustrated in the form of a wearable backpack that is positioned adjacent a user's back 12. In another embodiment, the sound device 10 can be a seat (e.g. movie theater seat, car seat). Sound device 10 includes a back region 10*a* that is positioned proximal to the user's back 12. Straps 10*b*, 10*c* pass over the user's shoulders, wrap under the user's arms and extend rearward to rejoin back region 10*a*. A pair of chest straps 10*d*, 10*e* connects to straps 10*b* and 10*c*, respectively. A buckle 10*f* selectively secures chest straps 10*d*, 10*e* together as shown in FIG. 3, thereby securing sound device 10 around the user's body. Straps 10*b*-10*e* may be selectively adjustable so that sound device 10 may be retained snugly against the user's body.

Figure 4:
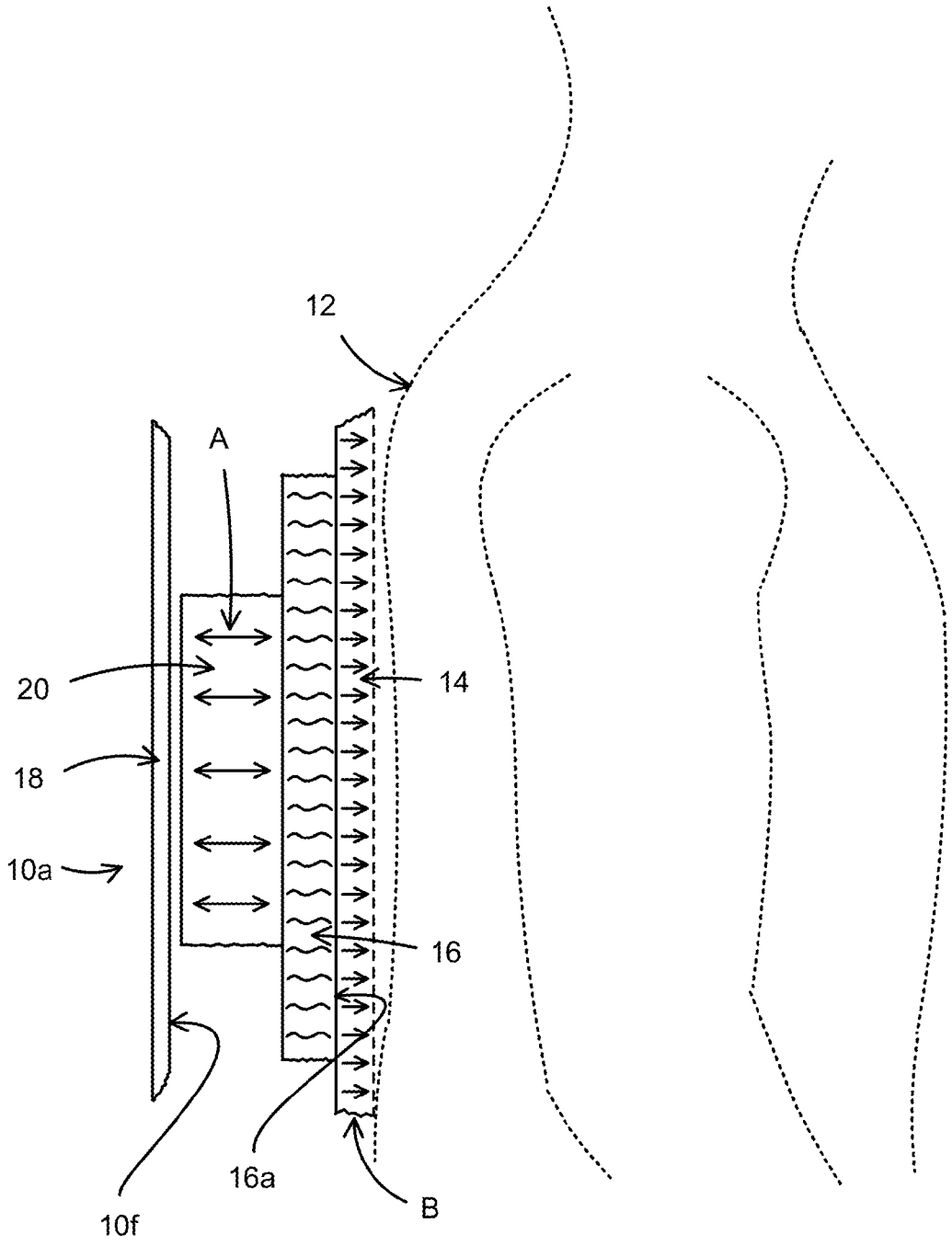
FIG. 4 is a cross-section taken along line 4-4 of FIG. 2.
Figure 5B:
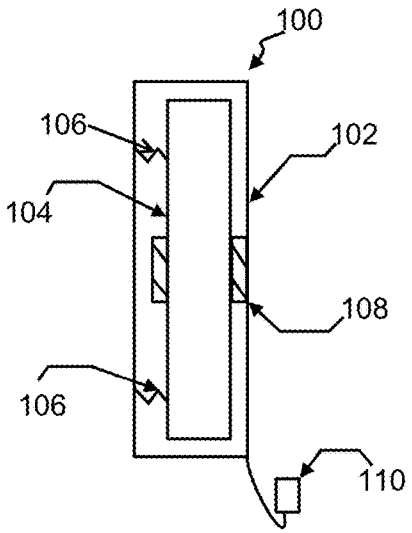
FIG. 5B PRIOR ART
FIG. 5B is a schematic cross-sectional side view of the PRIOR ART transducer of FIG. 5A.
Figure 5A:
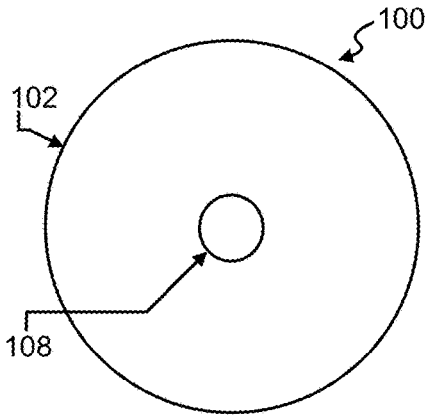
FIG. 5A PRIOR ART
FIG. 5A is a schematic front elevation view of a PRIOR ART transducer.
Figure 5C:
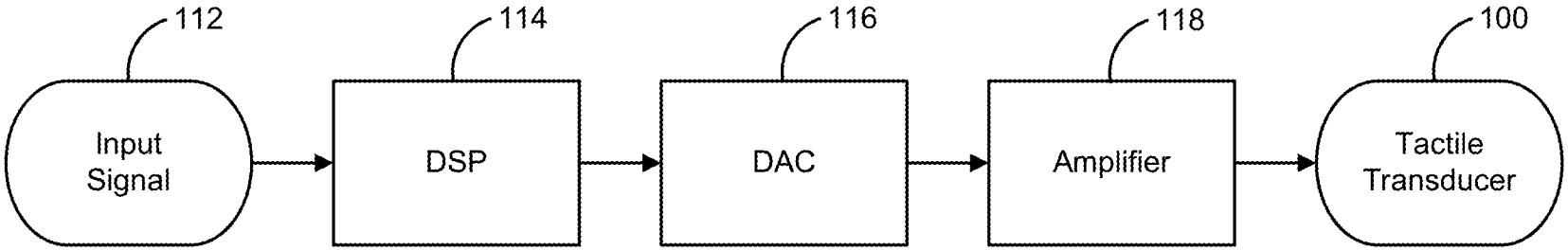
FIG. 5C PRIOR ART
FIG. 5C is a flow chart showing signal flow through a PRIOR ART tactile sound device that incorporates the transducer of FIGS. 5A and 5B.

Referring to FIGS. 1 and 4, back region 10*a* comprises an enclosure that includes but is not limited to a primary membrane 14 that is able to be positioned adjacent the user's back 12, a secondary membrane 16 that is adjacent to primary membrane 14, and an exterior membrane 18 that forms the exterior surface of sound device 10 and is spaced a distance from secondary membrane 16. An interior cavity 10*f* is defined between an interior surface of exterior membrane 18 and secondary membrane 16. It should be noted that the primary and secondary membranes may, instead, be a single membrane that embodies the properties of the two separate membranes as will be discussed hereafter. Furthermore, one or more additional membranes may be utilized in addition to the primary and secondary membranes in order to alter the transmission of vibrations to the user's body 12.

The primary membrane 14 can be a large, rigid membrane and can be made of any of a number of thermoplastics, such as polypropylene, HDPE, PVC, and the like, or of composite materials, such as carbon-fibre. This secondary membrane 16 can be a microcellular polymer membrane 104 made of microcellular elastomers (EVA), urethanes (PU), rubbers, and the like; but is preferably comprised of microcellular polyurethane, which has a greater dampening effect on vibrations. The secondary membrane 104 can have less surface area than the primary membrane 10

One or more electroactive transducers 20 may be positioned within cavity 10*f* and between exterior membrane 18 and secondary membrane 16. It will be understood that the electroactive transducer 20 as disclosed and discussed herein may be a tactile transducer. An electroactive transducer may encompass any other components that may be used to impart visceral sensation to the user of sound device 10.

Transducer(s) 20 are positioned on secondary membrane 16 or are embedded in secondary membrane 16. Other materials may be utilized within back region 10*a* to provide the enclosure formed thereby with structure, rigidity and strength. While these materials may form part of the enclosure, they are not discussed further herein. Suffice to say that the materials and structure of the enclosure so formed may adversely and inadvertently affect the quality of the motion produced by transducer 20.

Tactile sound device 10 may be provided with a control box 22 that is selectively securable to back region 10*a* in any suitable fashion. Wiring 24 extends outwardly from control box 22 and into the interior 10*f* (FIG. 4) of back region 10*a* of sound device 10 through an aperture 10*g* in exterior membrane 18, for example. Control box 22 may be operatively engaged with the one or more electroactive transducers 20 located within interior 10*f* of back region 10. Each electroactive transducer 20 may be any type of transducer that converts an electric signal into motion. Such electroactive transducers 20 include but are not limited to tactile transducers, exciters, piezoelectric actuators, piston drivers or any other mechanism that translates an electric signal received from control box 22 or another source into motion. The electric signal may be delivered via wiring 24 or may be delivered wirelessly, such as by way of a Bluetooth® signal or in any other suitable manner. Headphones 26 may be selectively operatively engaged with control device 22.

Transducer 20 may be directly attached to secondary membrane 16 or transducer 20 may be embedded in secondary membrane 16. Transducer 20 may include a magnet 24 (FIG. 6B) that moves back and forth and thereby generates vibrations such as those indicated by the arrows "A" in FIG. 4. Magnet 24 may be of a size similar to a hockey puck and have some weight. So, when magnet 24 moves back and forth, it creates a vibration that a person can feel. Vibrations "A" are dampened by secondary membrane 16 and are dissipated across the secondary membrane's surface area 16*a*. Primary membrane 14 is engaged with secondary membrane 16. Primary membrane 14 collects the vibrations from secondary membrane 16 and transfers those vibrations "B" (FIG. 4) to the user's back 12. Primary membrane 14 may comprise a large, rigid membrane that has approximately the same surface area as a region of the tactile sound device 10 proximal to the user's back 12. The vibrations "B" are transferred to the user's back 12 and produce visceral sensations in the use's body. These visceral sensations that are experienced by the user cause the user to feel the music or sounds through their body.

As indicated earlier herein issues may arise in the above-described system in that the vibrations "B" transferred to the user's back 12 and therefore experienced by the user, may not always have the desired frequency response. This is largely due to the fact that the person's own body acts as though it were a speaker enclosure. However, unlike a speaker enclosure that remains static and has static loading conditions on it, i.e., in the same location at all times and with the same external forces acting on it, a person may move around, including changing their position relative to the one or more transducers, or for example, pressing against the unit such that various components are compressed, or altering the relative orientation of the component when using the device sitting up or when lying down. Such movement may create dynamic loading conditions that can vary, including adversely affect the frequencies of the sounds and thereby of the generated vibrations, such that the frequency response is sub optimal for a user.

FIGS. 5A-5C show a PRIOR ART transducer and a signal flow through a tactile sound device that incorporates the transducer. The PRIOR ART transducer is generally indicated at 100 and includes an enclosure 102 in which is provided a magnet mass 104 that is engaged via a spring suspension 106 to enclosure 102. Transducer 100 also includes a voice coil 108 and is operatively engaged with a connector 110. FIG. 5C shows a signal flow in a tactile sound device incorporating transducer 100. An input signal 112 (the input signal being wired, wireless or signals from an I/O port) is processed in a Digital Signal Processor unit (DSP) 114 for a preset equalization response curve. This signal is passed on to a Digital Analog Converter (DAC) 116 where the signal is converted from a digital signal to an analog signal; is passed on to an amplifier 118 and then finally to the transducer 100.

It was found that in such a PRIOR ART system as is illustrated in FIG. 5C, under dynamic loading conditions (i.e., when the person wearing the sound device moves around), the frequency response depends, in part, on coupling of the device to the user's body, the user's posture, as well as the user's body composition (muscle, fat, bone). In the embodiment of the PRIOR ART sound device that is secured to a chair back, frequency response depends on all of above as well as on the interaction between the chair and the sound device. In the PRIOR ART SYSTEM, there is an amplifier on the main PCB and two wires carrying an amplified signal (i.e. higher voltage than the input signal) running to the transducer. In some embodiments, if a system requires a number of transducers, each transducer may require an amplifier, for example amplifier circuitry on the main PCB. This arrangement makes the circuit board bigger and requires amplified lines to the transducers; both of which are undesirable.

In one embodiment, these issues specified in the above paragraph are addressed by providing a sound device 10 that is capable of active feedback processing, including adaptive equalization in dynamic loading conditions. Sound device 10 can include an electroactive transducer with an active feedback system and an integral amplifier.

Figure 6B:
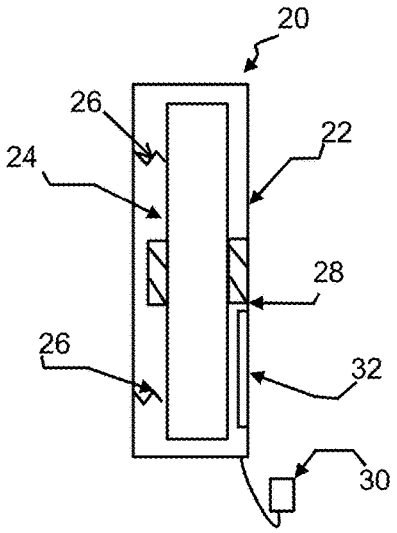
FIG. 6B is a schematic cross-section of the electroactive transducer of FIG. 6A.
Figure 6A:
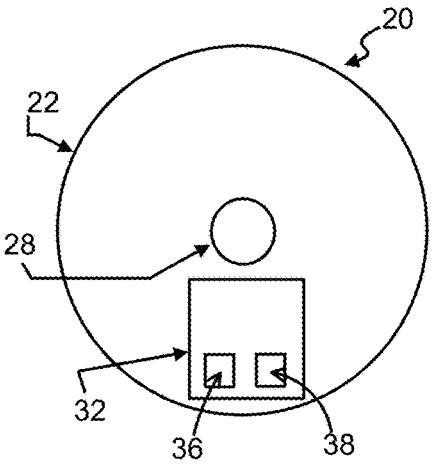
FIG. 6A is a schematic front elevation view of an electroactive transducer in accordance with an embodiment.

FIGS. 6A and 6B illustrate the electroactive transducer, generally indicated at 20. Transducer 20 may include an enclosure 22 in which is provided a magnet mass 24 that is engaged via a spring suspension 26 to enclosure 22. Transducer 20 also includes a voice coil 28 and is operatively engaged with a connector 30. Transducer 20 also includes a printed circuit board (PCB) 32 for an active feedback loop 34 (FIG. 7), an integral accelerometer 36, and an integral amplifier 38. Accelerometer 36 is integrated into the active feedback loop 34. It should be noted that PCB 32 may be mounted directly on magnet 24. The positioning of amplifier 38 on the PCB 32 on magnet 24 is such that the magnet 24 can act as heatsink for the amplifier 38. Amplifier 38 is a circuit component and accelerometer 36 is a circuit component. The active feedback loop 34 utilizes these two hardware components plus appropriate software to control the frequency response of the device. Transducer 20 also includes a power source (not shown) in the form of, for example, one or more batteries that provide power for moving magnet 24. In the currently disclosed system, amplifier 38 is integral with transducer 20. In embodiments of a sound device that may include more than one transducer, since the amplifier devices 38 can be located on the transducers 20, only line level signals (i.e. lower voltage) need to be sent to each transducer 20. This arrangement improves modularity, reduces component account and wiring complexity in the current system.

Figure 7:
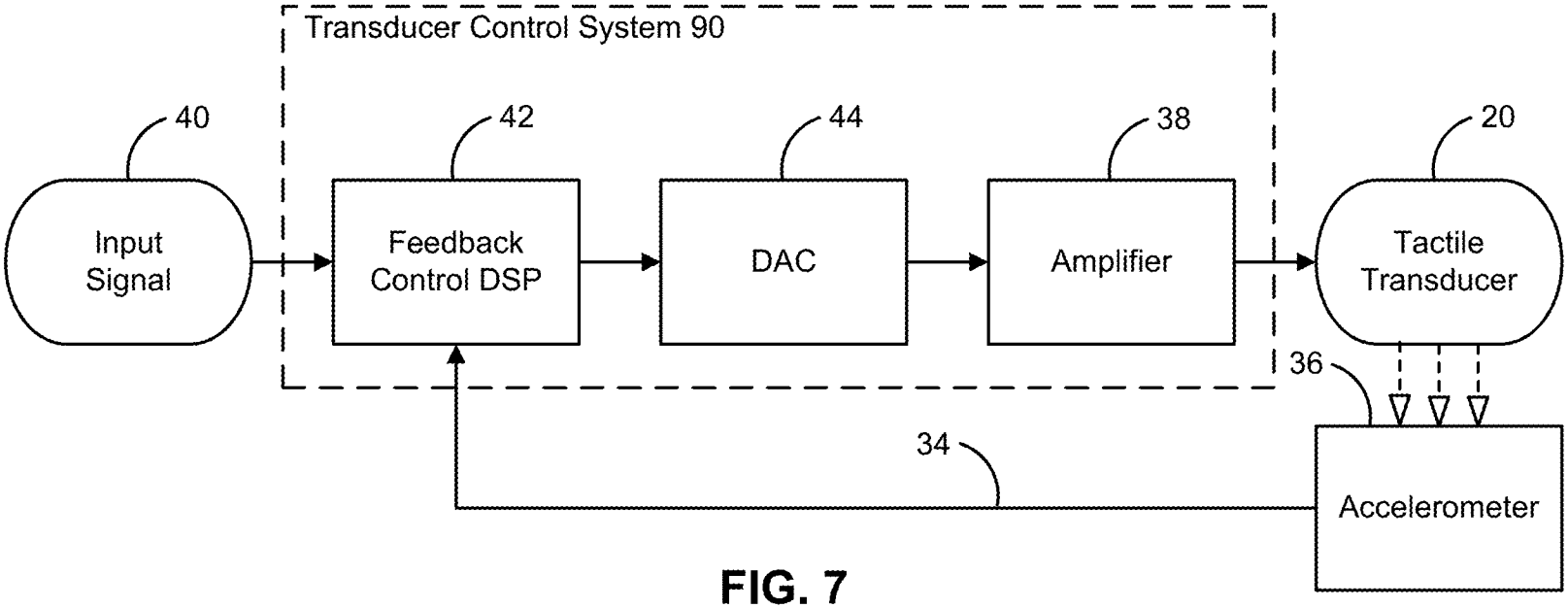
FIG. 7 is a flow chart showing signal flow through an exemplary tactile sound device in accordance with an embodiment, where the sound device incorporates the electroactive transducer of FIGS. 6A-6B which include an integral accelerometer and a feedback control loop.

The signal flow of sound device 10 incorporating electroactive transducer 20 is represented in FIG. 7. An input signal 40 is passed on to a specialized DSP unit in the form of a Feedback Control DSP unit 42. The input signal 40 can be, for example, a digital audio signal or an analog audio signal. Feedback control DSP 42 receives and modifies the signal (i.e., boosting or reducing or attenuating the signal and/or elements thereof as needed) depending on feedback input from accelerometer sensor 36 (FIG. 6A). The modified signal passes through a DAC 44, then to amplifier 38 and finally to transducer 20. The transducer 20 converts the electrical signal to vibrations "A" (FIG. 1) that are passed on to secondary membrane 16, then to primary membrane 14 and finally to the person's body 12.

If the person is moving around, the accelerometer 36 will provide a signal to Feedback Control DSP 40 that will then modify the signal being sent to DAC 44. The feedback control loop 34 (FIG. 7) thus provides adaptive equalization of the signal flow through sound device 10. In specific, the accelerometer 36 monitors the vibrations in the transducer 20 and generates an output signal that is indicative of the monitored vibrations. This output signal is transmitted to the feedback control DSP 42 via feedback control loop 34. The frequency response of the monitored vibrations is compared with a desired frequency response. A signal from the feedback control DSP 42 to the amplifier 38 is adaptive equalized (e.g. by adjusting different frequency bands) to more closely produce a desired frequency response in the system.

Feedback Control DSP unit 42 receives and modifies the signal by applying an equalization response curve, i.e. the DSP 42 measures the response curve, sees how the response curve deviates from the desired frequency response and then applies an equalization response curve so that the response matches the desired frequency response. The signal is modified depending on the input from accelerometer 36. This system may be used for one or more of auto-equalization, real-time automatic dynamic correction, excursion control (i.e., degree to which transducer vibrates back and forth as indicated by arrow "A" (FIG. 4)), maintaining a safe operating zone for the transducer 20, user feedback for example asking the user to adjust pressure on the transducer 20, as a sensor itself for user interface functions, diagnostics and testing. The system may store and/or communicate data from all of the above either locally or to a remote location for example using a network or other communications protocol.

Generally speaking, the feedback control DSP 42, DAC 44, and amplifier 38 are circuits that can be collectively referred to as a transducer control system 90 or transducer controller. The transducer control system 90 receives the input signal 40. The transducer control system 90 processes and applies equalization to the input signal 40 to generate an electrical signal that is provided to the transducer 20. The transducer control system 90 has feedback inputs that receives sensor output signals from sensors such as the accelerometer 36. In response to the sensor output signals, the transducer control system 90 can adjust how the electrical signal for the transducer 20 is generated, such as by applying equalization to adjusta frequency response of the electrical signal. Several different examples of the transducer control system 90 and its circuits will be described by reference to the remaining figures.

It should be understood that any adjustments made by the DSP 42 to the signal provided to the DAC 44 also have the effect of adjusting the signal output by the DAC 1204 and the electrical signal provided to the transducer 1206. In addition, in some embodiments, the feedback control DSP may incorporate or have an associated MCU which is capable of interpreting non-audio information that has one or more relationships with one or more analog or digital audio signals.

Figure 8:
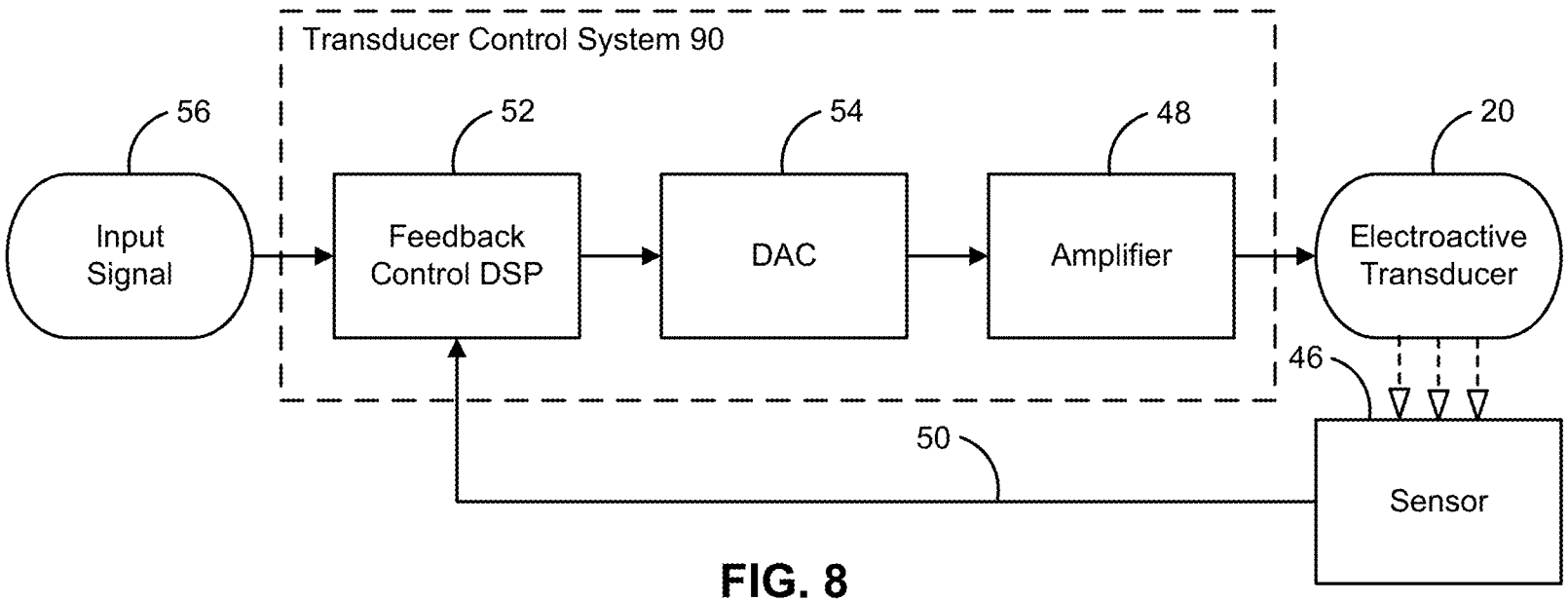
FIG. 8 is a flow chart showing signal flow through the tactile sound device in accordance with the present disclosure, where the sound device includes a sensor that senses other dynamic loading conditions as well as a feedback control loop.

In other embodiments, the electroactive transducer 20 may include one or more types of sensors in addition to or instead of accelerometer 36. These other one or more sensors are generally indicated by the reference number 46 (FIG. 8). Sensor(s) 46 may be integrated into the active feedback loop 50. Sensor(s) 46 may include for example, one or more position sensor, orientation sensor, force sensor, load sensor, temperature sensor, pressure sensor, proximity sensor, optical sensor, electrical sensor, and/or magnetic sensor (i.e., magnetometer). Each sensor can sense a physical phenomena (position, orientation, load, temperature, pressure, proximity, etc) and then generate a sensor output signal that indicates a level of the sensed physical phenomena (position, orientation, load, temperature, pressure, proximity, etc). Amplifier 48 and sensor(s) 46 are circuit components and the active feedback loop 50 in this embodiment system uses these two hardware components plus appropriate software to control transducer 20.

A temperature sensor may be used to monitor the temperature of voice coil 28. Sensor(s) 46 transmit a measured response to Feedback Control DSP 52 via feedback control loop 50. Feedback Control DSP 52, in turn, transmits a sensor output signal to a DAC 54 which alters the signal to amplifier 48 (and therefore also altering the electrical signal provided to the transducer 20) based on the measured response of the sensor(s) 46. The signal flow through the system shown in FIG. 8 may be initiated by an input signal 56 from another source being sent to Feedback Control DSP 52.

Figure 9A:
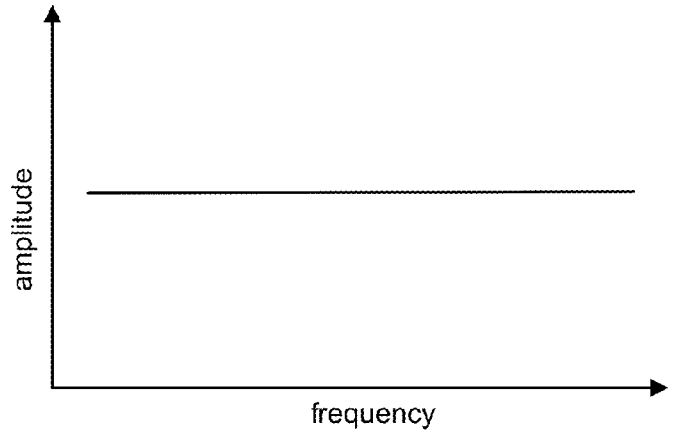
FIG. 9A shows an ideal frequency response curve.
Figure 9B:
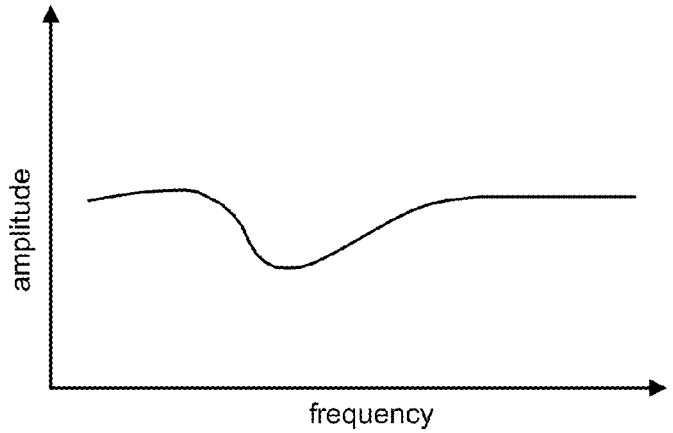
FIG. 9B shows an uncorrected frequency response curve where the response curve is generated in response to a first loading condition.
Figure 9C:
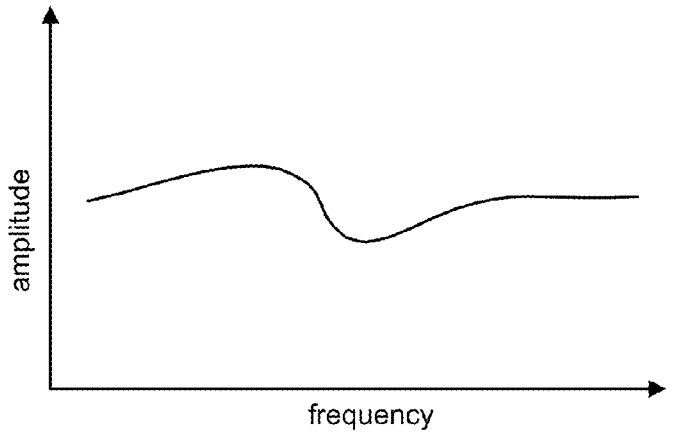
FIG. 9C shows an uncorrected frequency response curve that is generated in response to a second loading condition that differs from the first loading condition.

Referring to FIGS. 9A-9C there is shown three separate response curve graphs. For an electroactive transducer mounted in an enclosure, the frequency response of transducer depends in part on the forces acting on transducer. The term "frequency response" as used herein and in audio technology is the frequency range on the x-axis of a graph while intensity and loudness is on the y-axis. A desired frequency response in such devices would be illustrated as a flat response curve such as the one illustrated in FIG. 9A. For static loading conditions, i.e., such as in a speaker or a subwoofer, the desired frequency response of the transducer can be predictably and reliably set in advance with an equalization scheme to counter variations in frequency response brought on by the enclosure.

When, however, a PRIOR ART transducer (FIG. 5A) is used in a device that is under dynamic loading conditions, the frequency response curve will not be the desired frequency response curve illustrated in FIG. 9A. FIG. 9B shows a first uncorrected frequency response curve produced under a first dynamic loading condition. FIG. 9C shows a second uncorrected frequency response curve produced under a second dynamic loading condition. So, for example, the second uncorrected frequency response curve may relate to a different user, a different seat or chair in which a seated sound device is engaged, or a different method of securing the sound device to the user's body or to a garment, backpack or chair. These dynamic loading conditions require a dynamic equalization scheme to provide a flat frequency response such as that shown in FIG. 9A. In accordance with an aspect of the present disclosure, transducer 20 disclosed herein is able to provide such dynamic equalization in that the system is able to monitor the frequency response via the feedback control loop 34 or 50 (FIG. 7 or 8) and to adjust and correct the frequency response so that the desired flat frequency response curve of FIG. 9A may be achieved.

In one embodiment, the frequency response can be adjusted to achieve a desired frequency response that is not flat, but where some frequencies are attenuated and others are boosted. In some embodiments, such frequency curves may be further processed to limit transients (limiting), provide a constant output (compression), accentuate transients (expansion) and emphasize or deemphasize other audio characteristics.

Sensors

One or more pressure sensors may be embedded in, for example, a membrane, ideally the membrane in direct contact with a user, such that the relative pressure of the user to such membrane may be measured. This measurement may be used to calculate the relative position of the user to the membrane. For example, if the plane of the orientation of the membrane is nominally considered as representing vertical (that is zero degrees of tilt), even though it may not actually be so, then the if a user leans forward the pressure on the membrane will be reduced and if they lean backward it will be increased from a nominal or actual relative normalized relationship (for example when a configuration process is undertaken to establish a baseline for operation of the transducer arrangement with the specific user), between the membrane and the user. This information, expressed as a set of sensor data may be passed to a DSP which has previously been configured, which may then interpret such data and adjust the signal being sent to an amplifier connected to the transducer arrangement that is activating the membrane(s), so as to optimize the frequency response and other audio characteristics. For example, if the user is leaning into the membrane the input DSP may attenuate certain frequencies to account for the user pressing against the membrane with more force, resulting in the user receiving a stronger tactile output than if they were in a normal relationship with the membrane.

Figure 10:
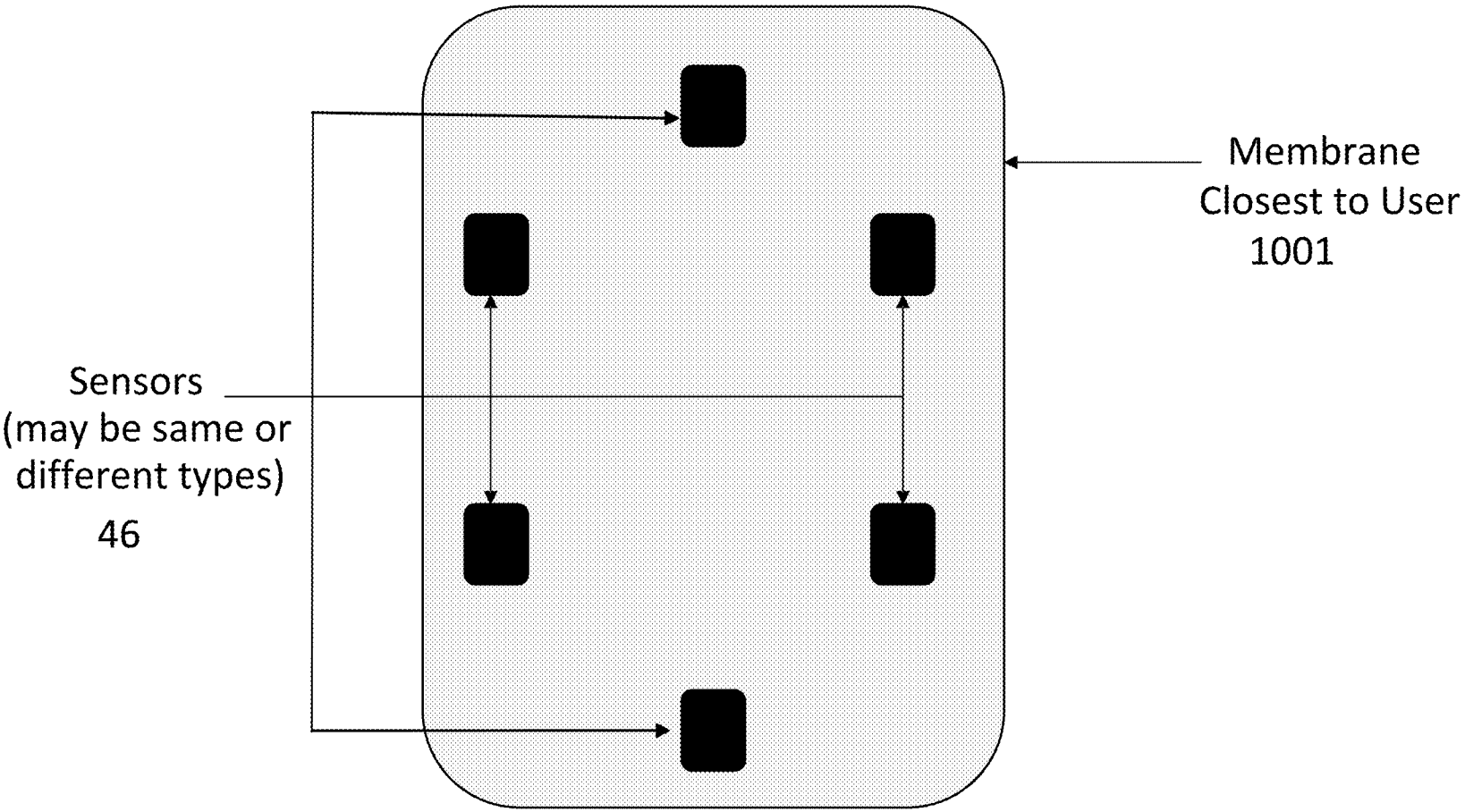
FIG. 10 illustrates example positioning of sets of sensors on or embedded into a membrane.

FIG. 10 illustrates example positioning of sets of sensors 46 on or embedded into a membrane 1001, which in this example is the primary membrane 14 closest to the user and which can be in direct contact with the users back. In some embodiments, as shown in FIG. 10, a membrane 1001 closest to the user may incorporate sets of sensors 46 such as pressure sensors or other sensors described herein. The sensors 46 are arranged for example such that vertical and lateral movement of a user may be determined.

Each sensor may be mounted so as to reduce any noise or other artifacts that reduce that sensors operating range and performance. For example, a sensor may be sufficiently isolated from the environment such that external inputs are at least in part neutralized and inputs form the monitored device, for example a transducer are optimized, at least in part through such isolation. For example a pressure sensor may be elastically isolated through being mounted in a rubber mounting.

Sensor Operation

In some embodiments, sensors may be used for:

i. Improving confidence or validation of measurements—measurements from multiple sensors can be compared against each other to improve confidence of and/or validation of measurements.

ii. Protection—for example using measurements to either adjust, limit or stop the response, input, or output signal when a critical threshold is approached, reached or exceeded, or if there has been a trend towards reaching this threshold from iii. Correction or enhancement—for example, using measurement to correct certain behavior or to enhance certain characteristics iv. Communication to internal or external systems for measurement, feedback control, reporting of critical faults and diagnostics Sensors may form part of an active feedback system as disclosed herein and in some embodiments, may be positioned in the following locations:

i. Adjacent/close to user;

ii. Embedded in/mounted on a membrane;

iii. On and/or in a transducer enclosure;

iv. Mounted on an external surface of an enclosure, wearable device and/or seat.

Figure 11:
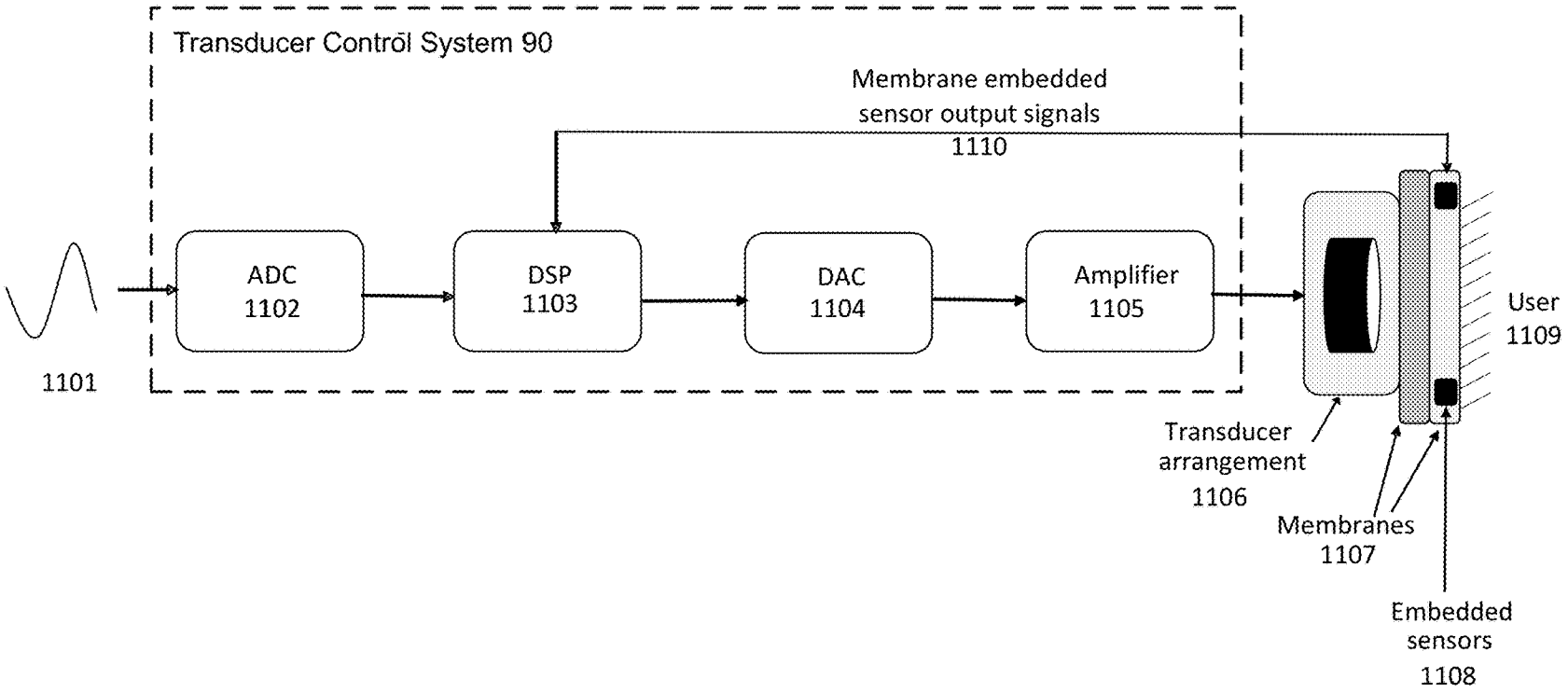
FIG. 11 is a block diagram showing signal flow through an exemplary tactile sound device in accordance with an embodiment.

One aspect is the placement of the sensors is the closeness of the sensor to the user which may provide more representative information as to the operations of a transducer arrangement as experienced by such a user. For example as shown in FIG. 11, the incoming audio signal 1101 is input in analog form to an ADC 1102 (Analog to Digital Converter), which transmits the converted signal in digital form to DSP 1103 (Digital Signal Processor), which includes the active feedback processes and is configured to receive sensor output signals 1110 from membrane embedded sensors. The input audio signal may be an also be encoded analog signal or a digital signal that can be read by the DSP 1103. DSP 1103 then transmits a processed digital signal to DAC 1104 (Digital to Analog Converter) which in turn converts the digital signal into analog form and transmits the signal in analog form to Amplifier 1105. Amplifier 1105 amplifies the analog signal and outputs an electrical signal suitable for energizing transducer arrangement 1106 to generate vibrations. The vibrations are transferred to one or more membranes 1107, which include one or more embedded sensors 1108. The membranes 1107 and sensors 1108 are proximal to a user 1109, such that there is physical contact between user and membranes with embedded sensors.

In this manner the sensors 1108, for example a pressure sensor, orientation sensor, load sensor, force sensor and the like, may create output signals that represent the output of the transducer arrangement 1106 as experienced by a user 1109. This information may then be transmitted in the form of sensor output signals 1110 to DSP 1103 as active feedback in real time, such that DSP may adjust the output signal to DAC 104 and consequent components to account for any artifacts or characteristics that are sub optimal for a user experience. For example this may include adjusting frequency response, which may include filtering (high pass/low pass/notch and the like), adjusting amplitude of one or more frequency segments (through boosting or attenuation) to create a more optimal frequency response as experienced by a user 1109. This may include configuration, in some embodiments, by the DSP 1103 to meet user preferences. For example, a galvanic skin response sensor can be used to measure user perspiration; which in turn can be used to calculate, through for example inference, certain user preferences and adjust an output amplitude in order to meet such calculated or specified user preferences. Other characteristics may include phase alignment with other audio sources, for example headphones, limiting or compression to reduce transients, noise or other filtering and the like.

The sensors may also be placed exterior to the device, on or around the user. For example, an external microphone may be used for phase alignment and/or time alignment of the transducer with other audio sources by adjusting a phase of the signal provided to the transducer. This sensor may also be used for detection of certain out of ordinary sounds emanating from the device.

Figure 12:
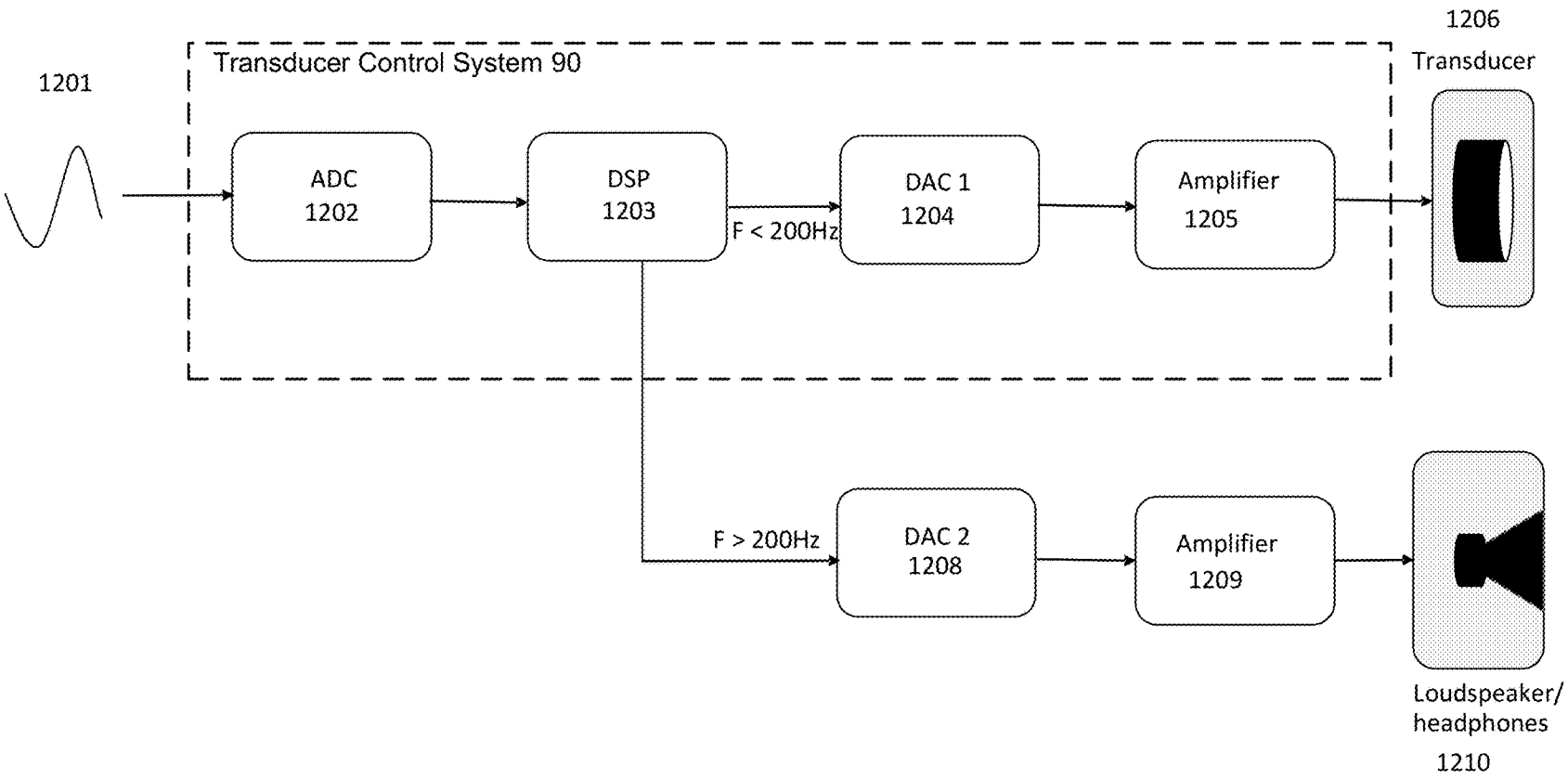
FIG. 12 is a block diagram showing signal flow through an exemplary tactile sound device in accordance with an embodiment.

FIG. 12 illustrates the DSP 1203 segmenting the input signal into different frequencies for multiple output devices, including at least one transducer arrangement, headphones and at least one loudspeaker. In this example embodiment, audio signal 1201 is transmitted to ADC 1202 which converts the analog signal 1201 from the source to a digital signal for transmission to DSP 1203. DSP 1203 segments the input signal by frequency range into separate signals for transmission to DAC1 1204 for subsequent energizing of transducer arrangement 1206 and to DAC2 1208 for subsequent energizing of loudspeakers of headphones 1210. In this example embodiment, such segmentation takes place at a cut-off frequency of 200 Hz, with a 12 dB per octave slope, however such frequency selection and/or alternative slopes may be configured in advance as part of an initialization process for a DSP and/or may be determined dynamically in response to incoming source materials and/or outputs from one or more sensors as illustrated in FIG. 13.

Figure 13:
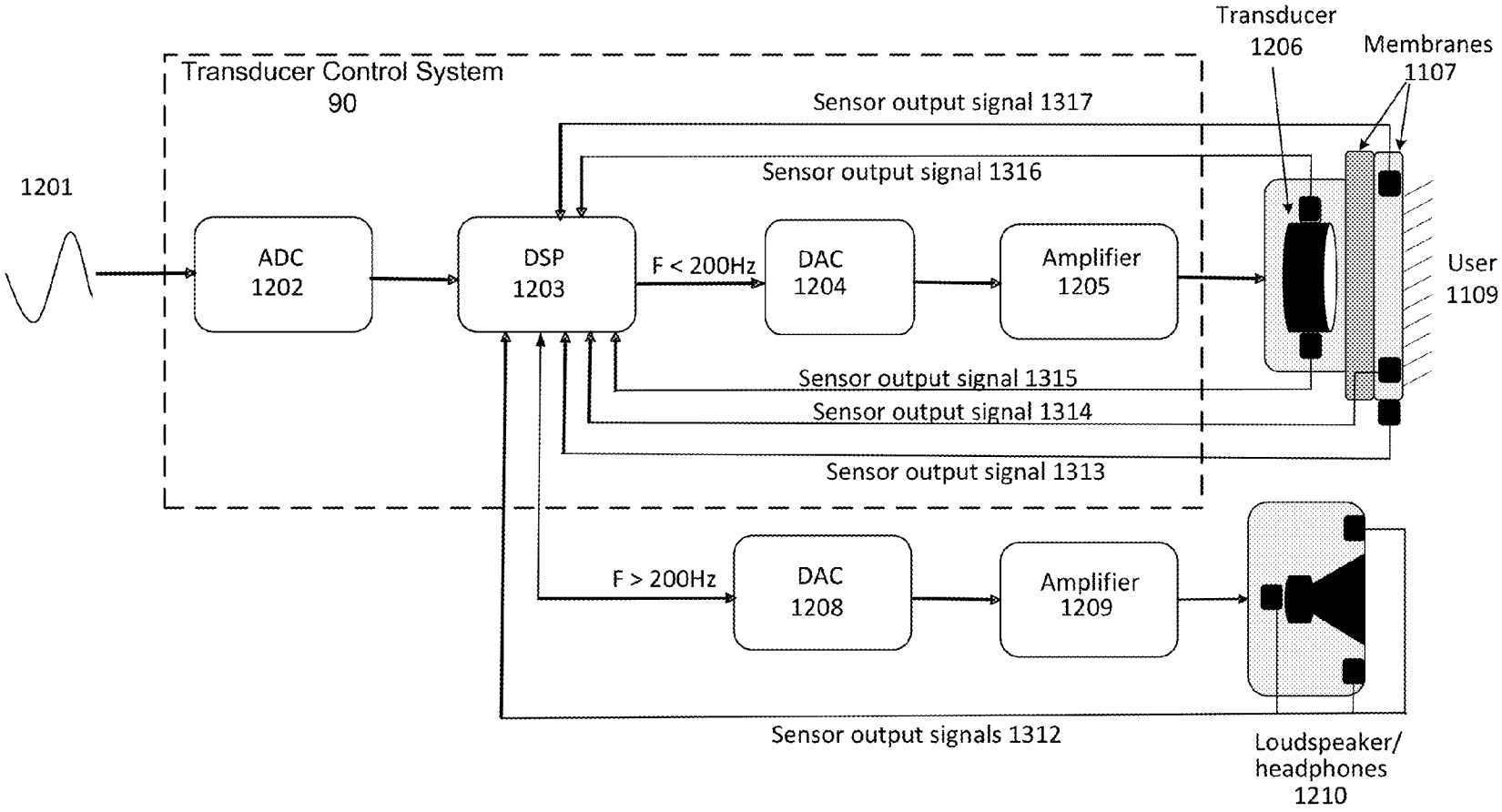
FIG. 13 is a block diagram showing signal flow through an exemplary tactile sound device in accordance with an embodiment.

Referring to FIG. 13, DSP 1203 segments the incoming audio signal into different frequency ranges and transmits different frequency signals to DAC 1 1204 and DAC 2 1208. A low pass filter is used to filter the input signal into low frequency components below a cut-off frequency of 200 Hz, and these low frequency components are provided to DAC 1204. A high pass filter is used to filter the input signal into high frequency components above a cut-off frequency of 200 Hz, and these high frequency components that are provided to DAC 1208. In other embodiments, full frequency audio signals can be provided to both DAC 1204 and DAC 1208.

The signals transmitted to these DACs 1204 and 1208 may be adjusted using outputs form one or more sets of sensors. For example, sensor output signals 1315 and 1316 from sensors attached to the transducer 1206 may be provided by, for example an accelerometer that measures acceleration of the voice coil and a temperature sensor that measures the temperature of the voice coil, which together are configured to provide information sets that may used as part of a transducer arrangement active feedback protection system.

DSP 1203 may also receive sensor output signals 1314 and 1317 from sensors embedded in one or more membranes 1107. For example, sensor output signal 1314 may be received from an orientation sensor. Sensor output signal 1317 may be received from a pressure sensor. DSP 1203 may receive sensor output signals 1313 from one or more sensors that are incorporated into one or more membranes to detect outputs of headphones or loudspeakers 1210. Such sensors may be embedded into such membranes and/or may placed proximal to a user, for example on their seat, clothing, placed on a convenient surface and the like. Information from such sensors may be transmitted to DSP by, for example Bluetooth, wife or other radio transmissions, one or more cable arrangements and the like. DSP may receive sensor output signals 1312 from sensors placed in or on loudspeakers and/or headphones 1210, including sensors that are internal or external to the enclosure of such devices.

Each of these information sets may individually and/or collectively inform the DSP's 1203 processing of audio signals so as to configure and/or optimize the reproduction of such signals for one or more users.

Figure 14:
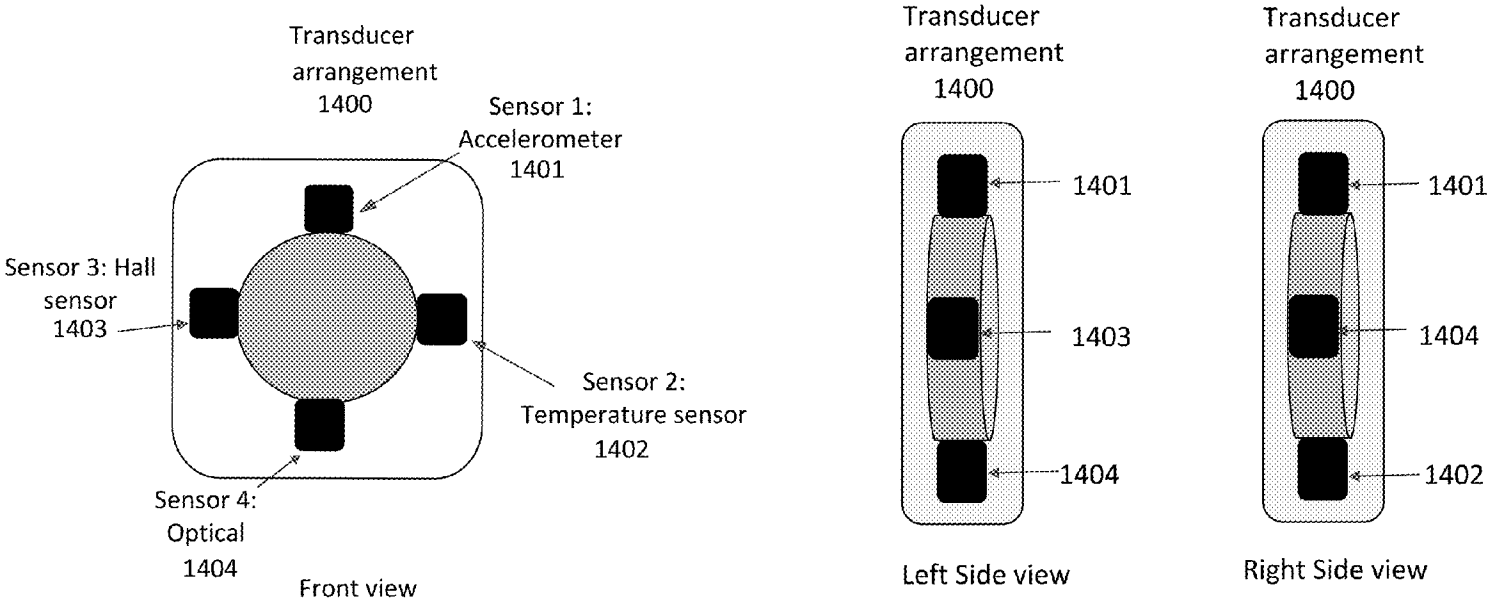
FIG. 14 illustrates a set of sensors placed in close proximity, including directly adjacent to a transducer arrangement, in accordance with an embodiment.

FIG. 14 illustrates a set of sensors placed in close proximity, including directly adjacent to a transducer arrangement. Each sensor provides an information set that may be employed to manage the operations of a transducer arrangement 1400 such that they stay within the predetermined safe operating conditions for such a device. For example transducer arrangement 1400 has four sensors connected so as to be enable to monitor the operations of the arrangement. These include Accelerometer 1401, Temperature sensor 1402, Hall effect sensor 1403 and Optical sensor 1404. As disclosed herein the accelerometer 1401 may monitor the velocity and acceleration of the voice coil and as such indicate if the excursion of the coil will exceed the safe operating parameters thereof. Such parameters may be stored by a DSP. Sensor 2, temperature sensor 1402, may monitor the temperature of the voice coil. This information may indicate when the heat build-up of the voice coil through its operations is likely to exceed one or more thresholds, which are stored by a connected DSP 1403. Hall effect sensor 1403, may indicate, for example, positioning such that when a transducer arrangement is moved from a known position it may provide an information set, in the form of a voltage which may then inform calculations of a connected DSP. Sensor 4, an optical sensor 1404, may be placed inside each transducer to monitor the voice coil operations, for example to provide a further information set to a DSP and/or to provide a second factor in support of information sets provided by the other sensors (for example 1402, 1402 and 1403). FIG. 14 illustrates some example positioning of such sensors in relation to a transducer arrangement.

Figure 15:
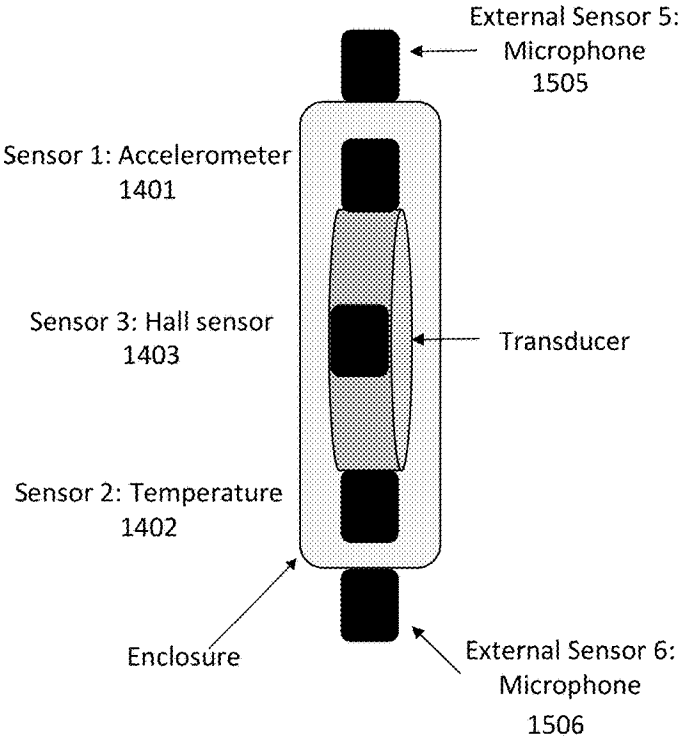
FIG. 15 illustrates the sensor set described in FIG. 14 with additional sensors, in accordance with an embodiment.

FIG. 15 illustrates the sensor set described in FIG. 14 with additional sensors in the form of microphones 1505 and 1506 that are mounted so as to monitor the environment in which the transducer arrangement is being operated. For example these sensors 1505 and 1506 may be used to receive the audio output of a speaker system used in conjunction with transducer arrangement, as illustrated in FIG. 13, such that they provide information to a DSP 1203 comprising part of an active feedback system. The sensors 1505 and 1506 may be mounted on the enclosure.

Figure 16:
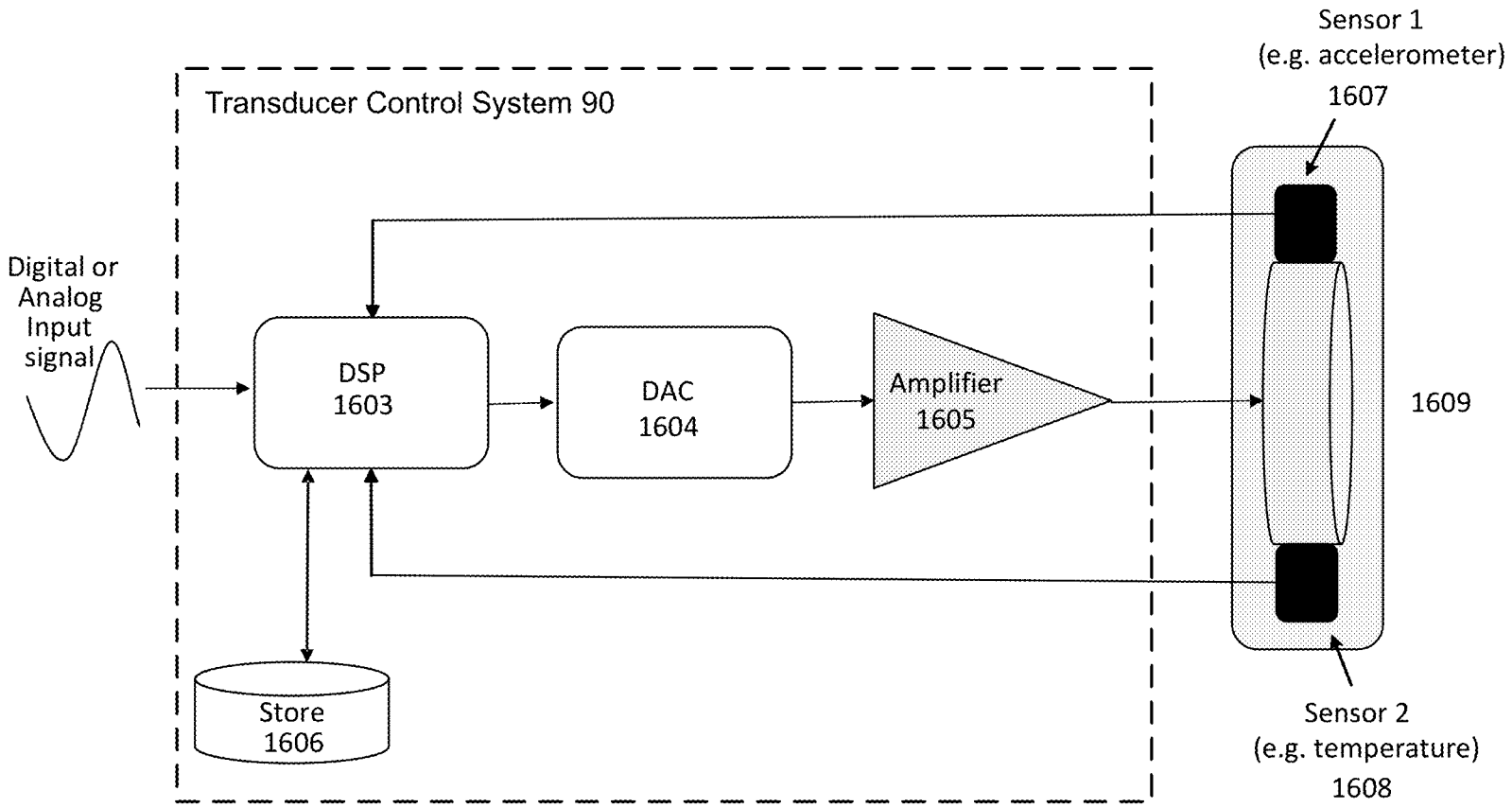
FIG. 16 is a block diagram showing signal flow through an exemplary tactile sound device in accordance with an embodiment.

FIG. 16 illustrates an active feedback protection system, whereby an accelerometer 1607 and a temperature sensor 1608 provide information to a DSP 1603 in the form of sensor output signals. The DSP 1603 compares such information with stored information sets held in information datastore 1606. Such stored information sets may include configurations, thresholds, historical information and/or the like. The information can represent normal and/or safe operating parameters of the transducer arrangement 1609. These information sets may be used by DSP 1603 in the calculation of variations of the output signals sent to DAC 1604 and Amplifier 1605 to maintain operation of transducer arrangement 1609 within safe operating conditions and/or within optimum operating conditions. The operations and components of FIG. 16 can also be integrated with any of the other embodiments described herein, such as FIG. 13.

In some embodiments many types of sensors may be deployed to provide information sets in the form of sensor output signals that may be processed by one or more DSP's in an active feedback system. The following non limiting examples are described below.

The sensors may be microphones that are used to capture sound levels and to generate an output signal indicative of the captured sound levels. The captured sound levels are used for initialization and configuration of DSP and/or for monitoring of output of loudspeakers and/or headphones to optimize and/or customize audio characteristics for user. A microphone may be used to detect sounds in certain frequency bands in order to adjust response of feedback system for protection or enhancement. For example, a microphone embedded in the system can be used to detect sounds in a known frequency band correlated with one or more certain failure modes. The active feedback system may then adjust, limit or stop the response according to the criticality of measurement.

The sensors may be physical or magnetic position sensors such as accelerometers, Hall effect sensors, orientation sensors such as gyroscopes or mercury tilt switches, electrical or mechanical pressure sensors, optical sensors such as photodiodes or photoresistors. The sensors may be used individually or in combination with other sensors for monitoring or detecting a change in a user's position or orientation relative to a previous state. This system for monitoring or detecting a change in user's position or orientation may comprise a combination of these sensors and/or may form an array of these sensors so as to detect the change in position of a user in relation to a transducer arrangement. These sensors or sensor arrays may be used to initialize and configure a user and/or transducer arrangement position in relation to an environment and/or each other.

A pressure sensor, which in some embodiments may include combinations of other sensors, for example force and load sensors, may provide a sensor output signal indicative of an amount of pressure being applied by a user to the tactile sound device. This information can be used for the initialization and configuration of a transducer arrangement. This information may also be used for detecting presence of a user and for varying (including muting) an output if the user is not present. This may include the relative and absolute positioning of a transducer arrangement that is worn by a user and/or against which a user sits, for example in a chair or sofa.

A proximity sensor may employ, for example photo resistors and or optical or IR LEDS so as to determine the reflections/refractions of optical and/or IR wavelengths, so as to determine the proximity of a user to a transducer arrangement and to generate a sensor output signal indicative of this proximity. For example, such a sensor may be placed in a seat back of in a wearable transducer arrangement so as to determine variation in distance of user to a seat, for example, to determine if the user is leaning forward and is thus less connected to the transducer array. In this example the DSP may increase the output of the transducer arrangement so as to maintain a constant amplitude of the signal as perceived by a user and/or may increase or decrease the amplitude to specific transducers in a transducer arrangement, for example increasing the amplitude in the base of the seat, whilst reducing amplitude in the seat back, where such a seat is fitted with such a transducer arrangement.

A back EMF (electro-magnetic field) sensor may be used to sense the operation of one or more transducers in a transducer arrangement, for example producing a PWM (Pulse Width Modulated) output that may be supplied to a DSP. Such a signal may be used for both protection of the transducer arrangement though maintaining operations of the transducer arrangement in a safe operating zone and/or for optimization and/or variance of the signal so as to provide a user with the appropriate experience.

Various sensors can be used to measure vibrations of a transducer. For example, an accelerometer may be used to measure force or acceleration of a transducer. A magnetometer may be used to measure the magnetic flux and thus force of a transducer.

A galvanic skin response sensor (e.g. EKG) may provide physiologic information sets that may be made available to DSP so as to optimize a users engagement with the experience provided by a transducer arrangement.

A temperature sensor may be either be a contact or non-contact type sensor. Temperature sensors include, but are not limited to, the following example types which may be employed to monitor the temperature of a transducer arrangement and/or the components thereof, including supporting components such as amplifiers (for example amplifier 1205 and/or 1209 in FIG. 12). A thermocouple or a thermopile may be used to monitor temperature of the electromotive elements, electrical elements or any functional or cosmetic enclosures. If a critical limit is exceeded, for example a temperature that could cause damage to the components, or a temperature that would be uncomfortable for a user, the DSP can reduce the amplitude of it output or complete mute its output. Examples of temperature sensors include thermostats, thermistors, resistive temperature detectors and thermocouples.

Transducer Protection Using Sensors

A transducer may have one or more associated sensors positioned adjacent to the transducer so as to monitor the operations of the transducer. This may include for example accelerometer and/or temperature sensors, both of which may be directly connected to a transducer. This is illustrated in FIG. 16.

For example, an accelerometer 1607 may monitor the displacement of the transducer 1609. A temperature sensor 1608 may monitor the operating temperature of the transducer 1609. The information generated by such sensors may then be communicated to the amplifier 1605 driving the transducer and/or a DSP 1603 controlling the input signal of such an amplifier. In both cases such information may form part of an active feedback loop which, at least in part operates to protect the transducer operations, such that the transducer 1609 is never outside the normal operating parameters of such a transducer 1609 or transducer arrangement 1609. For example, if the rate of acceleration of the transducer 1609 exceeds the parameters for which it is configured, a DSP 1603 may attenuate, filter, limit, compress or in other ways modify the input signal to the amplifier 1605 such that the transducer 1609 stays within normal operating conditions and is prevented from operating in unsafe operating conditions. In some embodiments, these conditions may be monitored by another type of sensor, for example a temperature sensor 1608, information from which has been used to configure such DSP as to the safe operating parameters.

In some embodiments, such sensors and active feedback may operate as an active protection feedback circuit with an amplifier configured to attenuate its output so as to maintain a normalized operating state for the transducer arrangement. For example, there may be specific inputs on such an amplifier that accept inputs from such sensors, and appropriate circuitry that reduces the gain (at specific frequencies or as overall gain at all frequencies) of the amplifier that is driving the transducer arrangement. An accelerometer may be used to monitor acceleration or force of the moving elements. If a critical limit is approached, reached or exceeded, the information generated from the sensor can be used to limit operation to a safe operating zone. Temperature sensors, such as a thermocouple or a thermopile may be used to monitor temperature of the electromotive elements, electrical elements or of any functional or cosmetic enclosures. If a critical limit is exceeded, for example a temperature that may cause damage to the components, and/or a temperature that may be uncomfortable for a user, the information generated by the sensor may be used to control the input signal to adjust, for example to limit or stop the output. Optical sensors may be used to monitor position of moving components and vary the input if a component reaches a position that is configured to be a critical limit. For e.g., in a transducer, optical or IR LED and photodiode pairs in either direct or reflective configurations can be used as light gates to limit over excursion of a component or movement of a component to and/or past a critical location.

DSP

A DSP processor may form part of an active feedback system. A DSP processor or processors may be integral to the unit and/or be external to the unit, connected wired or wirelessly in proximity to the device or remotely over a network. The DSP processor acts to accept input from one or more sensors, evaluate such input and undertake one or more actions based on this input. The DSP may have a repository of sensor input samples which are representative of specific operating circumstances of a transducer arrangement. For example, this may include the response of the sensors with a transducer arrangement aligned vertically or horizontally. In some embodiments, this may include one or more patterns created by one or more sensors that represent an optimum frequency response or other audio characteristics as measured by such sensors, or other sensors and/or selected by a user. The DSP may store information such as the following and not limited to: sensor inputs and measurements, calculations and correlations of measurements, critical measurements, critical faults and frequency of critical faults, corrections and enhancements performed for certain conditions, and general state of system or certain subsystems. The DSP processor may also communicate such information to subsystems or to external systems locally or over a network. The DSP may also receive configuration information, updated settings or system state settings from subsystems or external systems locally or over a network The DSP may initiate processes to modify the incoming audio signal so as to create an output signal that when fed to an amplifier connected to a transducer arrangement may produce an optimized and/or specific frequency response or other audio characteristics.

The DSP processes may include filtering (notch, high, low, multi band, bandpass and the like) with varying rates of Q (the steepness of the filter), for example to remove a specific resonance caused by, for example a seat or other environmental artifacts. DSP may employ a range of algorithms to vary signals fed to amplifiers. Such algorithms may be deployed through, for example analysis of the input signal and/or analysis of the sensor output signals. The DSP may also monitor the output of amplifier to further adjust for any discrepancies caused by operations of amplifier.

Other processes may include limiting the output audio signal to reduce transients and other peaks, compressing the audio to reduce overall dynamic range and produce a more consistent operating level. Other processes can include phase alignment of the output audio such that the audio signal is aligned with potentially other audio signals, for example those from headphones and/or loudspeakers, and the like.

The DSP may also act to attenuate the output signal and in some cases remove the output completely, generally in response to inputs from and evaluation of such information from those sensors that are protecting the transducers, for example accelerometer and temperature sensors, where the rate of acceleration may exceed or indicate that a transducer will exceed the safe operating environment for a transducer and/or temperature measurements which indicate, for example that the voice coil of the transducer is generating heat in excess of safe operating conditions. The DSP may, in some embodiments correlate multiple sensor inputs to avoid false positives and/or to compare such inputs with stored values so as to determine in advance of exceeding one or more thresholds an appropriate variation of the output signal to avoid a failure state.

The DSP may have an initial configuration state, whereby the DSP generates specific audio signals and then employs the sensors to measure such signals so as to create an optimum audio output for a specific transducer arrangement for one or more users in one or more environment. Such configurations may be stored by DSP and may generate modifications to an input signal so as to create an output signal with characteristics that optimize the audio experience for a user. In some embodiments, this may involve the DSP providing instructions to a user, through for example tactile sensations, such as creating an impulse from a specific point of a membrane, for example the left side, which informs the user to lean on that left side, so that their body position relative to the membrane may be determined and the output signal adjusted for optimum audio response. For example, one impulse may mean lean into the membrane, two pulses mean lean out, and three pulses mean configuration complete.

A DSP processor may also be configured to accept an incoming audio signal and process that signal such that the transducer arrangement is provided with the appropriate frequencies, for example under 200 Hz and the other signal portion, for example 200 Hz to 20 Khz is fed to another audio device, for example a set of headphones or pair (or set of) loudspeakers. In this example, the DSP will process the signals for both transducer arrangement and the other audio device (headphones/loudspeakers). Either of these other devices may have one or more sensors included in them and/or the DSP may have associated external sensors, such as microphones for monitoring loudspeakers, which are connected to as to provide sensor inputs that may inform the active feedback being undertaken by the DSP. For example, such microphone(s) may be placed on the front of a wearable vest, for example on each shoulder strap.

In some embodiments an active feedback system may incorporate a set of initialization and configuration operations, whereby the transducer arrangement is optimized to a specific user in a specific environment. For example, this may be a vehicle, room, seat, couch or any other environment, including those with other audio devices, for example speakers and/or headphones.

The configuration process may include instructions to a user, through tactile, audio or visual communications and combinations thereof. For example, a user may be asked to position themselves in a specific relationship to a transducer arrangement, for example aligning themselves so that they are parallel and in direct contact with the membrane providing the tactile outputs generated by the transducer arrangement.

An active feedback system may include integration of other audio sources, such as headphones and loudspeakers that provide frequencies above those delivered by a transducer arrangement. The integration of these other audio devices may involve active feedback system monitoring and/or controlling incoming audio signals prior to separation by frequency into signals for both transducer arrangement and other audio devices, for example with a cross over frequency of 200 Hz and a roll off of for example 12 db per octave. Active feedback systems may also operate on such separate input signals where each signal source is treated separately by the DSP processing of the active feedback. In this example, each DSP processor may inform each other DSP processor of the operations of the processor, and in some embodiments there may be a hierarchy or other overall active feedback control system for such DSP processors.

For example, an audio source comprising a fast rise time, such as a drum, may have a frequency range that includes both low frequencies and high frequencies that are delivered simultaneously to, for example, headphones for the high frequency and transducer arrangement for the low frequencies. In this example, the time alignment of the initial wave front can significantly impact the audio quality and as such the DSP processing may orient the relative time that the signal is presented to the amplifiers for both headphones and transducer arrangement such that the user experiences both simultaneously. This approach may be applied to loudspeakers, where the distance of the speakers from the user may be taken into account.

Enclosure

A transducer enclosure (e.g. enclosure 22) may incorporate multiple transducers, which for example may be mounted on a PCB which includes other supporting electrical and mechanical components. In some embodiments transducers may be embedded in a flexible material with a wiring harness attached to a PCB that incorporates those components not suitable for such mounting, such as amplifiers and the like.

In some embodiments, an enclosure may be made of materials, such as metal that are suitable for the dispersion of heat generated by transducers and associated components, such as amplifiers. Such metals include metals such as aluminum, steel, copper and the like. These may be combined with other materials that have heat dispersion properties, such as ceramics, polymers, carbon fibers composites, wood and natural fiber composites, semiconductor and the like. In some embodiments amplifiers that utilize such enclosures for heat dissipation may operate in Class D which often require less heatsink area per watt of output.

Enclosures may also incorporate mounting capabilities that enable them to be attached to wearable clothing, seats, couches and other artifacts. Enclosures may be rigid or flexible depending on their application.

Other Considerations

The description and illustration set out herein are an example and the embodiments are not limited to the exact details shown or described.

In one embodiment, an electroactive transducer includes an active feedback control loop and an amplifier. The active feedback control loop is integral with the transducer. The amplifier is integral with the transducer The active feedback control loop includes one or more sensors that are operatively engaged with the amplifier; wherein a sensor input is used to control a signal to the amplifier and to control the transducer in order to provide an optimal frequency response.

In one embodiment, a system for providing optimal frequency response in an electroactive transducer comprises: a feedback control DSP; a DAC; an amplifier; the transducer; and a sensor operatively engaged with the transducer and with the feedback control DSP. An input from the sensor controls a signal to the amplifier and thereby controls the transducer.

The sensor may be a position sensor, an orientation sensor, a force sensor, a load sensor, a temperature sensor, a pressure sensor, a proximity sensor, an optical sensor, an electrical sensor, or a magnetic sensor.

In one embodiment, a tactile sound device comprises a housing and an electroactive transducer positionable within the housing. The electroactive transducer is adapted to generate vibrations that are transferred to a person's body. The electroactive transducer includes an active feedback control loop and an amplifier. The active feedback control loop and the amplifier are integral with the electroactive transducer.

The housing is a wearable device that is positionable against the person's body. The wearable device can be a backpack, a vest, a body-suit, a garment or a piece of clothing and the backpack, vest, body-suit, garment or piece of clothing and the electroactive transducer is incorporated into the backpack, vest, body-suit, garment or piece of clothing.

The housing can be adapted to be used in conjunction with a seat. The housing can be used in conjunction with an office chair, a sofa, a theater seat, or a car seat. The housing can be integral with the seat. The housing can includes connectors that secure the housing against a backrest of the seat.

In one embodiment, a method of providing optimal frequency response in an electroactive transducer is disclosed. The method comprises: a) providing an audio system comprising a feedback control DSP; a DAC; an amplifier; the electroactive transducer; and one or more sensors that are operatively engaged with the electroactive transducer and the feedback control DSP; b) generating a vibration by way of the electroactive transducer; c) monitoring the vibration using the one or more sensors; d) comparing the monitored vibration with an optimal frequency response; e) transmitting an input signal from the one or more sensors to the feedback control DSP based on the comparison of the vibration and the optimal frequency response; f) sending a signal from the feedback control DSP to the DAC; g) sending a signal from the DAC to the amplifier; h) sending a signal from the amplifier to the electroactive transducer; i) repeating steps b) to e) and adjusting the input signal based on the monitored vibration.

In one embodiment, an electroactive transducer, a tactile sound system incorporating the electroactive transducer and a system and method for producing an optimal frequency response from the same is disclosed. The electroactive transducer includes an integral active feedback control loop and an integral amplifier. The transducer is operatively engaged with a feedback control DSP, a DAC, and a sensor, such an as accelerometer. The transducer generates vibrations that are transferred to the body of a user so that the user will feel the sound or music to which he or she is listening. The sensor monitors the vibrations in the transducer and transmits an input signal to the feedback control DSP. The monitored vibration is compared with an optimal frequency response and a signal from the feedback control DSP to the amplifier is adjusted to more closely produce an optimal frequency response in the system.

What is claimed is:

1. A tactile sound device comprising:

a transducer to convert an electrical signal into motion;

a first membrane directly coupled to the transducer to receive vibrations from the transducer;

a second membrane configured to interface with a user's body to transfer vibrations received from the first membrane to the user's body;

a first sensor to monitor the vibrations of the transducer, the first sensor disposed within the second membrane;

a second sensor coupled to, or disposed within a same enclosure as, the transducer; and one or more circuits to generate the electrical signal based on both a first signal received from the first sensor that monitors the vibrations of the transducer and a second signal received from the second sensor.

2. The tactile sound device of claim 1, wherein the one or more circuits comprise:

a digital signal processor (DSP) to receive an audio input signal, the first signal from the first sensor, and the second signal from the second sensor, the DSP processing the audio input signal to generate a modified signal based on the first signal from the first sensor and the second signal from the second sensor;

a digital to analog converter (DAC) to convert the modified signal into an analog signal; and an amplifier to amplify the analog signal to generate the electrical signal for the transducer.

3. The tactile sound device of claim 1, wherein the one or more circuits adjusts an equalization of the electrical signal based on the first signal received from the first sensor.

4. The tactile sound device of claim 3, wherein the one or more circuits compares a desired frequency response with a frequency response of the vibrations as indicated by the first signal received from the first sensor, and adjusts the equalization of the electrical signal based on the comparison.

5. The tactile sound device of claim 1, wherein the first sensor is an accelerometer.

6. The tactile sound device of claim 1, wherein the second sensor is a different type of sensor than the first sensor.

7. The tactile sound device of claim 6, wherein the second sensor is a temperature sensor.

8. The tactile sound device of claim 6, wherein the second sensor is a pressure sensor.

9. The tactile sound device of claim 6, wherein the second sensor is a proximity sensor.

10. The tactile sound device of claim 6, wherein the second sensor is a hall effect sensor.

11. The tactile sound device of claim 6, wherein the second sensor is an orientation sensor.

12. The tactile sound device of claim 6, wherein the one or more circuits adjust an equalization of the electrical signal provided to the transducer based on the first signal received from the first sensor, and wherein the one or more circuits adjust the electrical signal provided to the transducer based on the second signal received from the second sensor to prevent unsafe operating conditions.

13. The tactile sound device of claim 1, further comprising:

a third sensor, wherein the third sensor is a microphone that monitors sound from a loudspeaker or headphones, and the one or more circuits generate the electrical signal for the transducer based on a third signal received from the microphone.

14. The tactile sound device of claim 13, wherein the one or more circuits adjust a phase of the electrical signal for the transducer further based on the third signal received from the microphone.

15. The tactile sound device of claim 1, wherein the one or more circuits perform low pass filtering on an input audio signal to identify low frequency components below a low pass cut-off frequency, the one or more circuits generating the electrical signal for the transducer to include the low frequency components.

16. The tactile sound device of claim 1, wherein the tactile sound device is a wearable device.

17. The tactile sound device of claim 1, wherein the tactile sound device is a seat.

18. A method of operation in a tactile sound device, comprising:

converting an electrical signal into motion with a transducer of the tactile sound device;

transferring vibrations from the transducer to a user's body through:

a first membrane directly coupled to the transducer to receive vibrations from the transducer; and a second membrane configured to interface with the user's body to transfer vibrations recieved from the first membrane to the user's body;

monitoring the vibrations of the transducer with a first sensor disposed within the second membrane; and generating the electrical signal based on both a first signal received from the first sensor that monitors the vibrations of the transducer and a second signal received from a second sensor coupled to, or disposed within a same enclosure as, the transducer.

* * * * *